US010077593B2

(12) United States Patent
Meeks

(10) Patent No.: US 10,077,593 B2
(45) **Date of Patent: *Sep. 18, 2018**

(54) THRESHOLD ASSEMBLY FOR AN ENTRYWAY SYSTEM

(71) Applicant: Quanex Homeshield, LLC, Mounds View, MN (US)

(72) Inventor: James W. Meeks, Eaton, OH (US)

(73) Assignee: QUANEX HOMESHIELD LLC, Mounds View, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/330,818

(22) Filed: Nov. 7, 2016

(65) Prior Publication Data

US 2017/0058592 A1 Mar. 2, 2017

Related U.S. Application Data

(63) Continuation-in-part of application No. 14/952,593, filed on Nov. 25, 2015, now Pat. No. 9,487,992.

(60) Provisional application No. 62/084,943, filed on Nov. 26, 2014.

(51) Int. Cl.
*E06B 1/70* (2006.01)
*E06B 7/23* (2006.01)

(52) U.S. Cl.
CPC ..... *E06B 1/70* (2013.01); *E06B 7/2312* (2013.01); *E06B 7/2316* (2013.01)

(58) Field of Classification Search
CPC ..... E06B 1/70
USPC ..... 49/468, 469
See application file for complete search history.

(56) References Cited

U.S. PATENT DOCUMENTS

| | | | |
|---|---|---|---|
| 88,502 | A | 3/1869 | Morris |
| 126,014 | A | 4/1872 | Brown et al. |
| 435,658 | A | 9/1890 | Brennaman |
| 600,301 | A | 3/1898 | Barger |

(Continued)

FOREIGN PATENT DOCUMENTS

| | | | |
|---|---|---|---|
| CH | 142682 | A | 10/1930 |
| CH | 181976 | A | 1/1936 |

(Continued)

OTHER PUBLICATIONS

Endura Performance Standard, "The Real World is Never Perfect. Compensate with Z-AC-Z-Articulating Cap Sill", Sep. 2016, 5 pages.

(Continued)

*Primary Examiner* — Jerry E Redman
(74) *Attorney, Agent, or Firm* — Howard & Howard Attorneys PLLC

(57) ABSTRACT

A threshold assembly for use with an entryway disposed within an aperture of a structure, which has an exterior and an interior and includes a door panel moveable between open and closed positions, includes a sill and a rail. A rail is rotatably supported above the upper sill surface between an initial position when the door panel is in the open position, and a second position different from the initial position when the door panel is in the closed position. A biasing member is disposed between the upper sill surface of the sill to bias the rail from the second position toward the initial position. A protrusion extends from the sill towards the rail, with the protrusion configured to rotatably support the rail and configured to prevent the biasing member from rotating the rail beyond the initial position.

19 Claims, 32 Drawing Sheets

(56) References Cited

U.S. PATENT DOCUMENTS

| | | | |
|---|---|---|---|
| 618,013 | A | 1/1899 | Roeder |
| 1,210,535 | A | 1/1917 | Riley |
| 1,231,621 | A | 7/1917 | Lane |
| 1,468,958 | A | 9/1923 | Champion |
| 1,485,208 | A | 2/1924 | Altman et al. |
| 1,595,827 | A | 8/1926 | Frisque |
| 1,620,526 | A | 3/1927 | Emig |
| 1,993,506 | A | 3/1935 | Fauner |
| 2,022,408 | A | 11/1935 | Dahl |
| 2,077,845 | A | 4/1937 | Madsen |
| 2,129,381 | A | 9/1938 | Oftedal et al. |
| 2,188,049 | A | 1/1940 | Kammerer |
| 2,202,482 | A | 5/1940 | Dahl |
| 2,293,292 | A | 8/1942 | Goellner |
| 2,579,875 | A | 12/1951 | Stanko |
| 2,663,056 | A | 12/1953 | Hardgrave |
| 2,718,677 | A | 9/1955 | Cornell |
| 2,818,614 | A | 1/1958 | Lapka, Jr. |
| 2,853,749 | A | 9/1958 | West |
| 2,934,802 | A | 5/1960 | Shekter |
| 3,079,652 | A | 3/1963 | Wahlfeld |
| 3,123,870 | A | 3/1964 | Coe |
| 3,126,051 | A | 3/1964 | Sussin |
| 3,235,917 | A | 2/1966 | Skubic |
| 3,690,037 | A | 9/1972 | Kempel |
| 3,762,100 | A | 10/1973 | Kempel |
| 3,900,967 | A | 8/1975 | Bursk et al. |
| 4,003,162 | A | 1/1977 | Britt |
| 4,283,884 | A | 8/1981 | Dumenil et al. |
| 4,513,536 | A | 4/1985 | Giguere |
| 5,010,690 | A | 4/1991 | Geoffrey |
| 5,018,307 | A | 5/1991 | Burrous et al. |
| 5,230,181 | A | 7/1993 | Geoffrey et al. |
| 5,943,825 | A | 8/1999 | Procton et al. |
| 6,367,201 | B1 | 4/2002 | Massey et al. |
| 7,263,808 | B2 | 9/2007 | Massey et al. |
| 7,389,611 | B2 | 6/2008 | Palenske |
| 7,472,516 | B2 | 1/2009 | Pepper et al. |
| 7,644,539 | B2 | 1/2010 | Baxter |
| 7,669,369 | B2 | 3/2010 | Henry et al. |
| 8,074,699 | B2 | 12/2011 | Jones et al. |
| 8,413,383 | B2 | 4/2013 | Van Camp et al. |
| 8,522,483 | B2 | 9/2013 | Van Camp et al. |
| 8,813,427 | B2 | 8/2014 | Meeks |
| D722,387 | S | 2/2015 | Van Camp |
| 8,991,100 | B2 | 3/2015 | Van Camp et al. |
| 8,991,101 | B2 | 3/2015 | Van Camp et al. |
| 9,371,682 | B2 | 6/2016 | Van Camp et al. |
| 9,487,992 | B2 | 11/2016 | Meeks |
| 2002/0194787 | A1 | 12/2002 | Bennett |
| 2003/0005644 | A1 | 1/2003 | Reithmeyer et al. |
| 2005/0210754 | A1 | 9/2005 | Ferrell |
| 2006/0283087 | A1 | 12/2006 | Baxter |
| 2008/0229669 | A1 | 9/2008 | Abdollahzadeh et al. |
| 2010/0031578 | A1 | 2/2010 | Hartwell |
| 2010/0257789 | A1 | 10/2010 | Meeks |
| 2013/0047518 | A1 | 2/2013 | Van Camp et al. |
| 2014/0318020 | A1 | 10/2014 | Van Camp et al. |
| 2014/0338265 | A1 | 11/2014 | Petta |

FOREIGN PATENT DOCUMENTS

| | | | |
|---|---|---|---|
| CH | 211412 | A | 9/1940 |
| CH | 223469 | A | 9/1942 |
| CN | 2553052 | Y | 5/2003 |
| DE | 1988359 | U | 6/1968 |
| DE | 295 10 131 | U1 | 10/1996 |
| DE | 29510131 | U1 | 10/1996 |
| EP | 0327840 | A2 | 8/1989 |
| EP | 0419894 | A2 | 4/1991 |
| FR | 945217 | A | 4/1949 |
| GB | 9888 | | 3/1899 |
| GB | 484933 | A | 5/1938 |
| GB | 603651 | A | 6/1948 |
| GB | 607050 | A | 8/1948 |
| GB | 2451878 | A | 2/2009 |
| JP | S61085690 | U | 6/1986 |
| JP | H0626278 | A | 2/1994 |
| JP | H07269235 | A | 10/1995 |
| JP | H08144647 | A | 6/1996 |
| JP | H0988433 | A | 3/1997 |
| JP | H09209663 | A | 8/1997 |
| JP | H1037626 | A | 2/1998 |
| JP | H10110579 | A | 4/1998 |
| JP | H10184045 | A | 7/1998 |
| JP | 2002030873 | A | 1/2002 |
| JP | 2003013672 | A | 1/2003 |
| JP | 2005023628 | A | 1/2005 |
| JP | 2006089920 | A | 4/2006 |
| KR | 100594929 | B1 | 6/2006 |

OTHER PUBLICATIONS

Endura Products, Inc., "Z-Articulating Cap Sill", Sep. 2, 2016, downloaded from http://www.enduraproducts.com/product-overview/sills/z-series/ on Oct. 26, 2016, 2 pages.

Machine-assisted English translation for CH142682 extracted from espacenet.com database on Jan. 3, 2018, 3 pages.

Machine-assisted English translation for CH 181976 extracted from espacenet.com database on Jan. 3, 2018, 4 pages.

Machine-assisted English translation for CH 211412 extracted from espacenet.com database on Jan. 3, 2018, 3 pages.

Machine-assisted English translation for CH 223469 extracted from espacenet.com database on Jan. 3, 2018, 4 pages.

English language abstract and machine-assisted English translation for CN 2553052 extracted from espacenet.com database on Jan. 3, 2018, 4 pages.

Machine-assisted English translation for DE 1 988 359 extracted from espacenet.com database on Jan. 3, 2018, 9 pages.

Machine-assisted English translation for DE 295 10 131 extracted from espacenet.com database on Jan. 3, 2018, 7 pages.

English language abstract and machine-assisted English translation for EP 0 327 840 extracted from espacenet.com database on Jan. 3, 2018, 8 pages.

English language abstract and machine-assisted English translation for EP 0 419 894 extracted from espacenet.com database on Jan. 3, 2018, 7 pages.

Machine-assisted English translation for FR 945 217 extracted from espacenet.com database on Jan. 3, 2018, 5 pages.

Partial machine-assisted English translation for JPS 61-085690 extracted from PAJ database on Jan. 3, 2018, 2 pages.

English language abstract and machine-assisted English translation for JPH 06-026278 extracted from espacenet.com database on Jan. 3, 2018, 5 pages.

English language abstract and machine-assisted English translation for JPH 07-269235 extracted from espacenet.com database on Jan. 3, 2018, 8 pages.

English language abstract and machine-assisted English translation for JPH 09-088433 extracted from espacenet.com database on Jan. 3, 2018, 7 pages.

English language abstract and machine-assisted English translation for JPH 08-144647 extracted from espacenet.com database on Jan. 3, 2018, 10 pages.

English language abstract and machine-assisted English translation for JPH 09-209663 extracted from espacenet.com database on Jan. 3, 2018, 12 pages.

English language abstract and machine-assisted English translation for JPH 10-037626 extracted from espacenet.com database on Jan. 3, 2018, 7 pages.

English language abstract and machine-assisted English translation for JPH 10-110579 extracted from espacenet.com database on Jan. 3, 2018, 11 pages.

English language abstract and machine-assisted English translation for JPH 10-184045 extracted from espacenet.com database on Jan. 3, 2018, 11 pages.

English language abstract and machine-assisted English translation for JP 2002-030873 extracted from espacenet.com database on Jan. 3, 2018, 10 pages.

(56) References Cited

OTHER PUBLICATIONS

English language abstract and machine-assisted English translation for JP 2003-013672 extracted from espacenet.com database on Jan. 3, 2018, 11 pages.
English language abstract and machine-assisted English translation for JP 2005-023628 extracted from espacenet.com database on Jan. 3, 2018, 10 pages.
English language abstract and machine-assisted English translation for JP 2006-089920 extracted from espacenet.com database on Jan. 3, 2018, 17 pages.
Machine-assisted English translation for KR 10-0594929 extracted from espacenet.com database on Jan. 3, 2018, 6 pages.

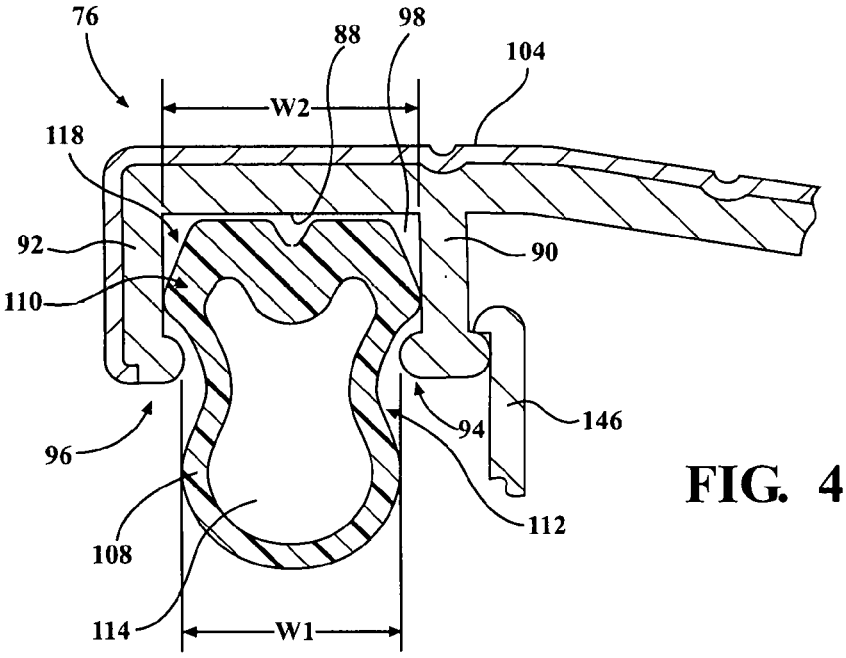
FIG. 40
FIG. 41
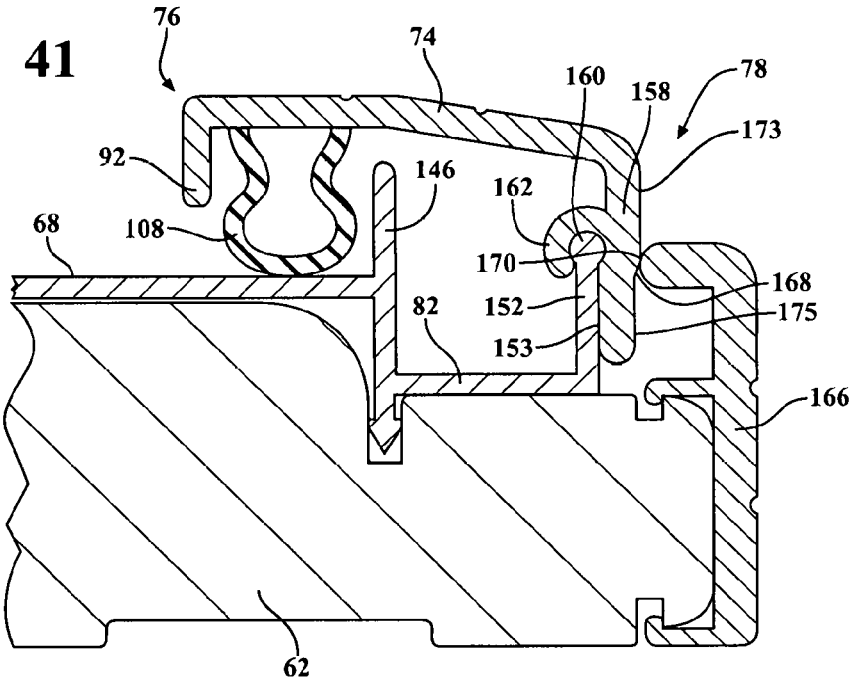

THRESHOLD ASSEMBLY FOR AN ENTRYWAY SYSTEM

CROSS-REFERENCE TO RELATED APPLICATIONS

This application is a continuation-in-part of application Ser. No. 14/952,593, now U.S. Pat. No. 9,487,992, filed Nov. 25, 2015, which claims priority to and all the benefits of U.S. Provisional Patent Application No. 62/084,943 filed on Nov. 26, 2014, which is herein incorporated by reference in its entirety.

BACKGROUND OF THE INVENTION

1. Field of the Invention

The subject invention generally relates to a threshold assembly for an entryway system.

2. Description of the Related Art

Threshold assemblies are used with entryway systems to seal between a rail of the threshold assembly and a door panel of the entryway system. The entryway system includes a door frame and the door panel coupled to the door frame. The threshold assembly includes a sill with the rail disposed on the sill below the door panel when the door panel is in a closed position. The rail may be biased to adjust to and engage the door panel to create a water-tight seal between the rail and the door panel. In other words, as opposed to setting the door panel and/or the rail to a predetermined height relative to each other at the time of installation to create a proper seal between the door panel and the rail, the rail instead self-adjusts to the door panel when the door panel is in the closed position to seal against the door panel.

Traditionally, the rail is biased toward the door panel such that the door panel engages the rail and the rail seals against the door panel. Water and debris may still infiltrate between the sill and the rail in conventional threshold assemblies when the door panel is in the open position or the closed position. As such, there remains a need to provide an improved threshold assembly.

SUMMARY OF THE INVENTION AND ADVANTAGES

A threshold assembly for use with an entryway disposed within an aperture of a structure, which has an exterior and an interior and includes a door panel moveable between open and closed positions, includes a sill and a rail. The sill extends between an exterior side for facing the exterior of the structure and an interior side for facing the interior of the structure. The sill presents an upper sill surface extending from the exterior side to the interior side. The upper sill surface is configured to face the door in the closed position. A rail is rotatably supported above the upper sill surface between an initial position when the door panel is in the open position, and a second position different from the initial position when the door panel is in the closed position. A biasing member is disposed between the upper sill surface of the sill and the rail, such that the biasing member is engaged with the rail and supported by the upper sill surface to bias the rail from the second position toward the initial position. A protrusion extends from the sill towards the rail, with the protrusion configured to rotatably support the rail and configured to prevent the biasing member from rotating the rail beyond the initial position.

Accordingly, the threshold assembly stops infiltration of water and debris between the upper sill surface and the lower rail surface when the door panel is in the open position or the closed position, and when the rail is in the initial position or the second position. Additionally, the threshold assembly stops infiltration of water and debris between the rail and the door panel when the door panel is in the closed position. Also, the protrusion configured to rotatably support the rail and configured to prevent the biasing member from rotating the rail beyond the initial position helps optimize the self-adjustment feature of the rail of the threshold assembly.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 40 is a side cross-sectional view of another embodiment of the biasing member of FIGS. 17-19, 20, 29, 34, and 37;

FIG. 41 is a side cross-sectional view of another embodiment of the threshold assembly, with the rail in the initial position;

DETAILED DESCRIPTION OF THE INVENTION

Figure 1:
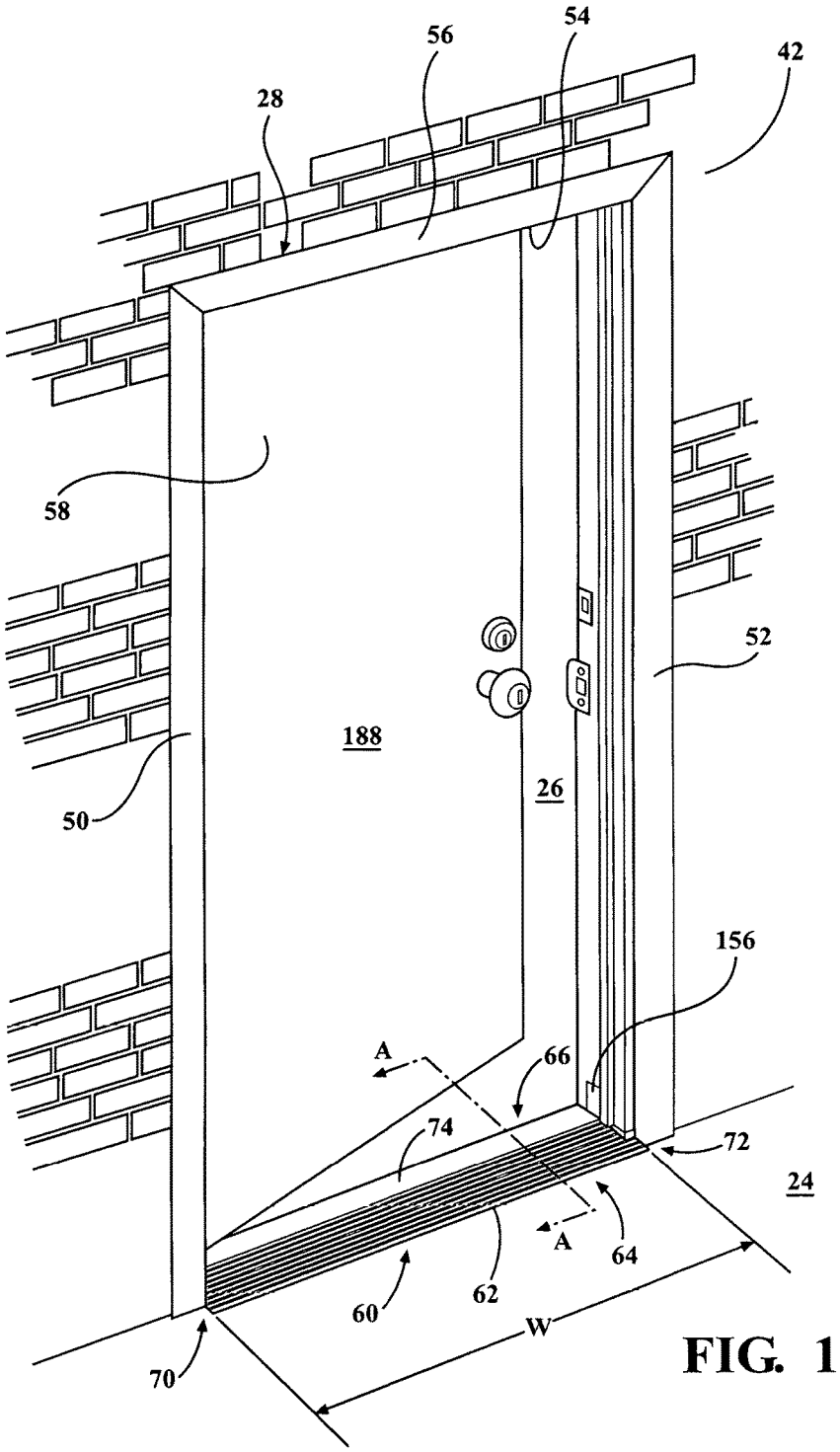
FIG. 1 is a perspective view of an entryway system showing a door frame, a door panel, first and second door jambs, and a threshold assembly comprising a rail, a sill, and a biasing member.

With reference to the Figures, wherein like numerals indicate like parts throughout the several views, an entryway system 40 disposed within an aperture of a structure 42 is generally shown in FIG. 1. The structure 42 is typically a building, such as a commercial or residential building, with the entryway system 40 providing access into the structure 42. The structure 42 defines an exterior 44 and an interior 46. More specifically, the structure 42 has a wall dividing the exterior 44 (outside environment) and the interior 46 of the structure 42. The entryway system 40 is disposed within the aperture to separate the exterior 44 and the interior 46 of the structure 42. Said differently, the exterior 44 and the interior 46 are disposed on opposite sides of the entryway system 40. As such, the entryway system 40 can be used to access the exterior 44 from the interior 46 of the structure 42 and, alternatively, the entryway system 40 can be used to access the interior 46 from the exterior 44 of the structure. It is to be appreciated that the entryway system 40 may be utilized in any suitable configuration for providing access therethrough the wall of the structure 42.

The entryway system 40 includes a doorframe 48 disposed in the aperture of the structure 42. The doorframe 48 includes first and second door jambs 50, 52 spaced from each other. The doorframe 48 defines an opening 54 for providing access between the interior 46 and the exterior 44 of the structure 42. Typically, the first and second door jambs 50, 52 are substantially parallel to one another. However, it is to be appreciated that the first and second door jambs 50, 52 may be disposed transverse to one another or in any other suitable configuration. The doorframe 48 typically includes a door head 56 transverse to and extending between the first and second door jambs 50, 52.

Figure 2:
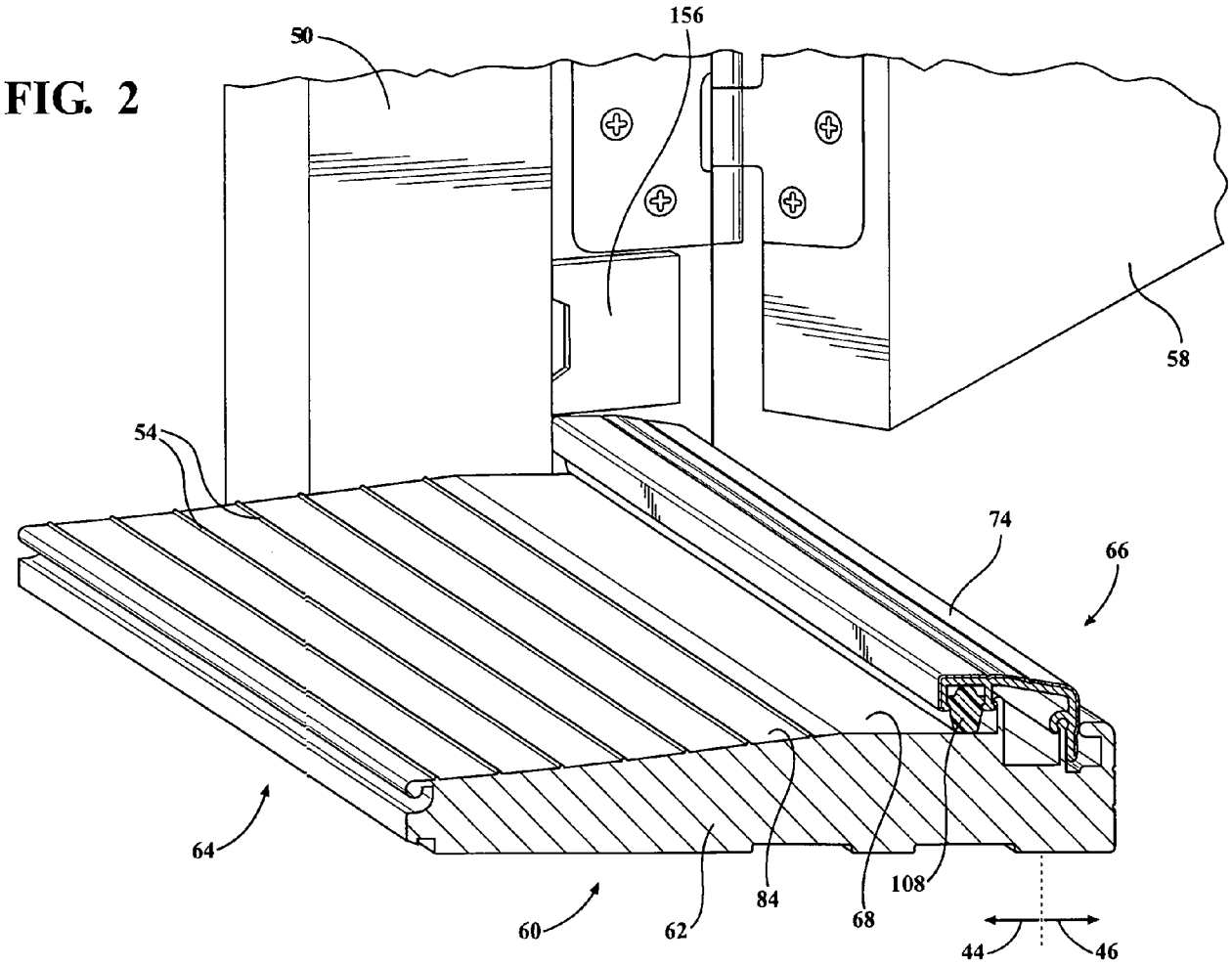
FIG. 2 is a perspective view of a portion of the entryway system showing a cross-section of the threshold assembly.
Figure 4:
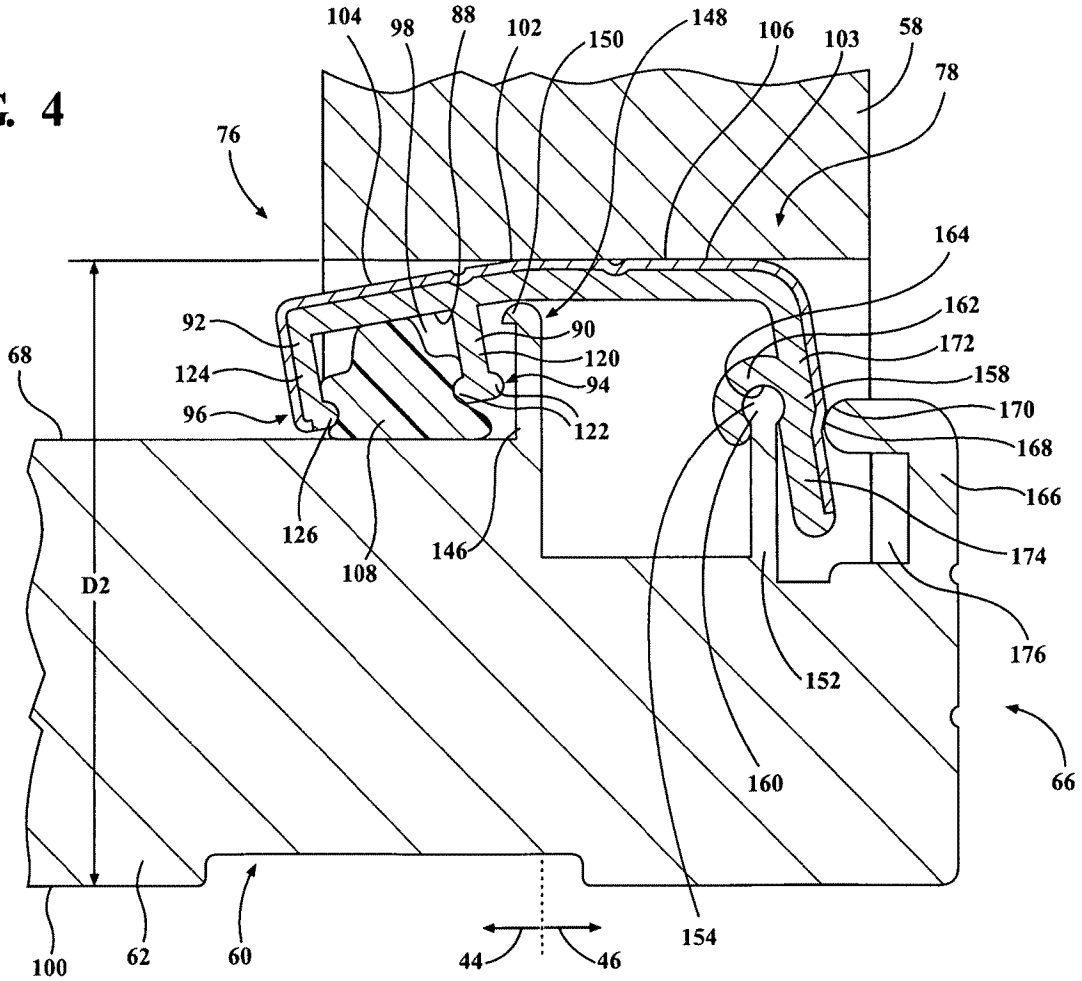
FIG. 4 is a side cross-sectional view of the threshold assembly, with the door panel in a closed position and the rail in a second position.

The entryway system 40 includes a door panel 58 coupled to the doorframe 38 and capable of moving between an open position, as shown in FIG. 2, and a closed position, as shown in FIG. 4. The door panel 58 is disposed in the opening 54 when in the closed position. The door panel 58 is typically pivotally coupled to one of the first and second door jambs 50, 52 via a hinge or hinges, not shown. The door panel 58 is pivotally coupled to the first door jamb 50 in the Figures for exemplary purposes only. The movement of the door panel 58 between the open and closed positions may be further defined as pivoting between the open and closed positions. Said differently, the door panel 58 is hinged to one of the first and second door jambs 50, 52. The door panel 58 is typically disposed outside of the opening 54 when in the open position. The closed position refers to any position of the door panel 58 in which at least a portion of the door panel 58 extends into the opening 54. The closed position may further define a completely closed position in which the door panel 58 is entirely disposed within the opening 54. In the completely closed position, the door panel 58 may abut the doorframe 38 to substantially inhibit access through the opening 54.

As shown in FIG. 1, the entryway system 40 includes a threshold assembly 60 disposed between the first and second door jambs 50, 52. As best shown in FIGS. 2 and 4, the threshold assembly 60 is also disposed below the door panel 58 with the door panel 58 contacting the threshold assembly 60 in the closed position. The threshold assembly 60 is disposed within the opening 54 opposite the door head 56 and typically extends toward each of the first and second door jambs 50, 52. It is to be appreciated that the threshold assembly 60 may be disposed anywhere within the opening 54.

The threshold assembly 60 includes a sill 62 extending between an exterior side 64 facing the exterior 44 of the structure 42 and an interior side 66 facing the interior 46 of the structure 42. The sill 62 presents an upper sill surface 68 extending from the exterior side 64 to the interior side 66. The upper sill surface 68 is configured to face the door panel 58 in the closed position.

Typically, the sill 62 extends between a first end 70 and a second end 72 defining a width W of the sill 62. The first end 70 of the sill 62 may be adjacent the first door jamb 50 and the second end 72 may be adjacent the second door jamb 52. More typically, the first end 70 abuts the first door jamb 50 and the second end 72 abuts the second door jamb 52. However, it is to be appreciated that one or both of the first and second ends 70, 72 may be spaced from the first and second door jambs 50, 52, respectively.

The sill 62 may be one piece or may comprise numerous components. As shown in FIGS. 5-12 and 41-44, the sill 62 typically includes a sill base 80 and a sill deck 82. Alternatively, the sill base 80 and sill deck 82 may be integral such that the sill 62 may be a one-piece sill 62, as shown in FIGS. 1-4 and 12-14. It is to be appreciated that the sill 62 may comprise any number of components, and that the components may be individual components or the components may form a one-piece sill 62.

Figure 5:
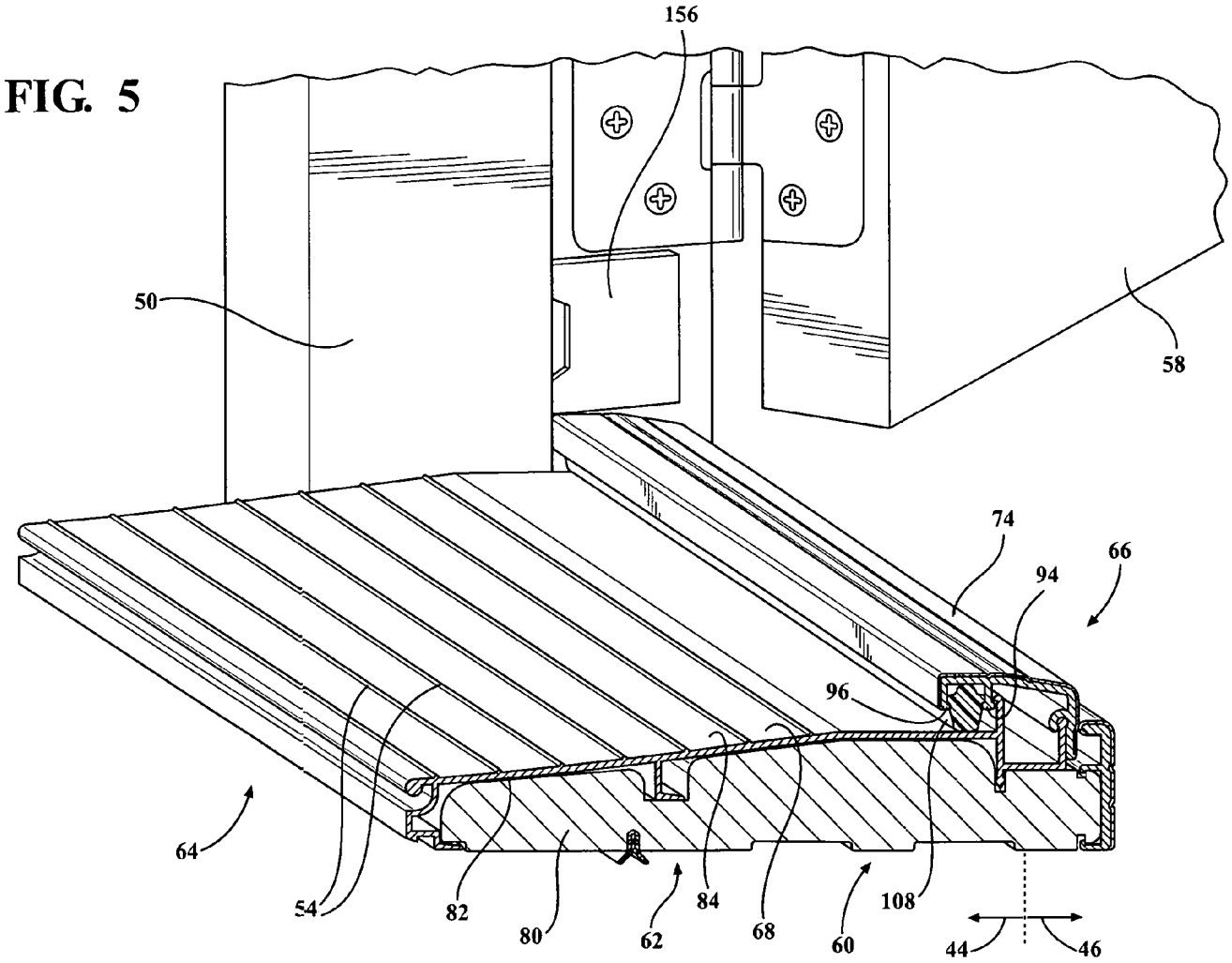
FIG. 5 is a perspective cross-sectional view of the threshold assembly, the first door jamb of the door frame, and the door panel, with the door panel in the open position and the rail in the initial position, and with the sill comprising a sill base and a sill deck.
Figure 6:
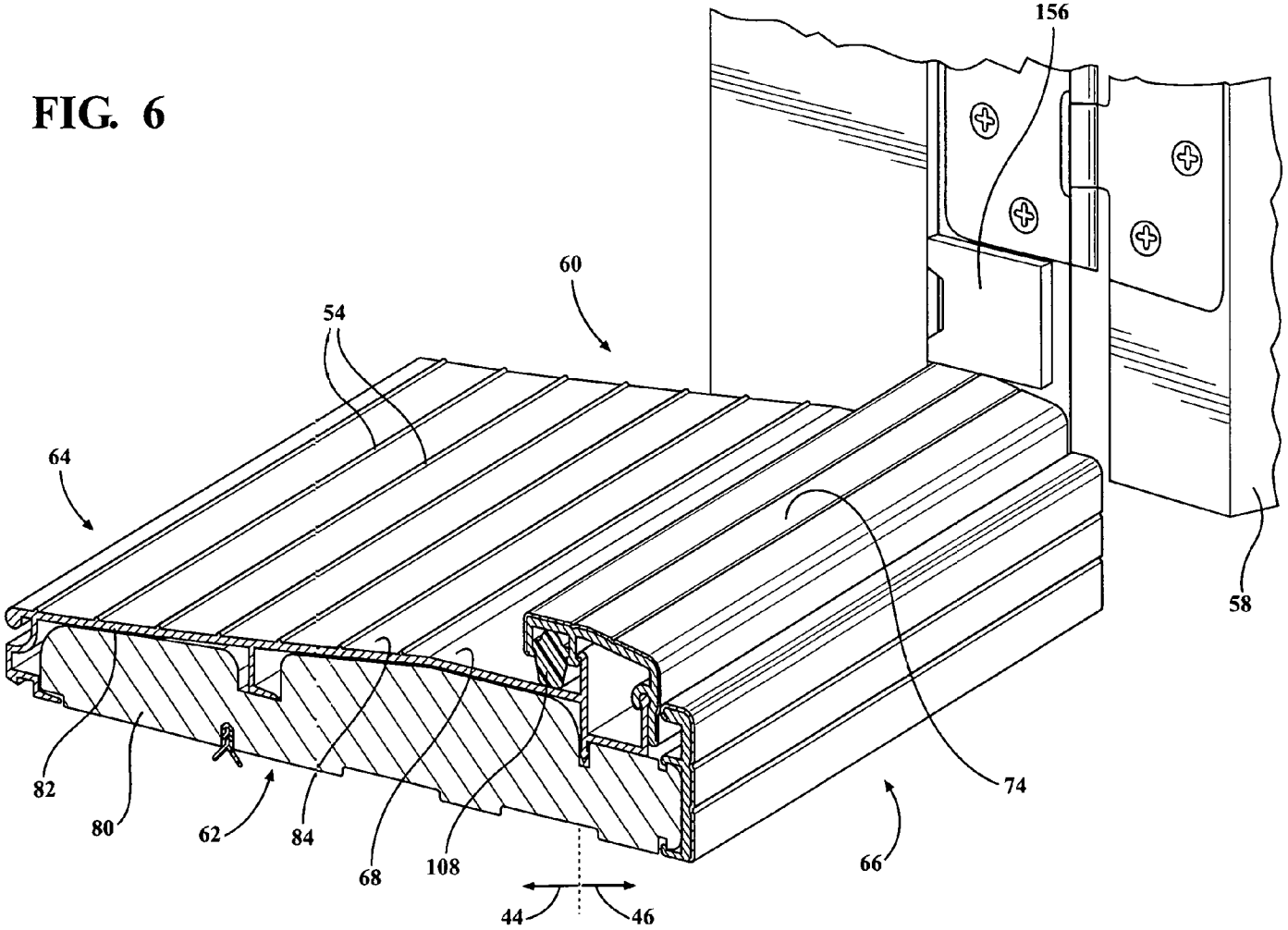
FIG. 6 is a perspective cross-sectional view of the threshold assembly, with the door panel in the open position and the rail in the initial position, and with the sill comprising the sill base and the sill deck.

As best shown in FIGS. 1-3 and 5, the sill 62 may present a tread surface 84 adjacent the exterior side 64 and extending toward the interior side 66. When the sill 62 is a two-piece sill 62, the sill deck 82 presents the tread surface 84, as shown in FIG. 5. When the sill 62 is a one-piece sill 62, the upper sill surface 68 of the sill 62 typically presents the tread surface 84, as shown in FIG. 2.

The upper sill surface 68 is typically sloped downwardly away from the interior side of the sill 62. The slope of the upper sill surface 68 promotes positive drainage of any fluid that may contact the upper sill surface 68. Said differently, the slope of the upper sill surface 68 directs fluid from the threshold assembly 60 toward the exterior 44 of the structure 42. Positive drainage typically refers to a desired drainage path of the fluid, whereas negative drainage typically refers to an undesired drainage path of the fluid. For example, positive drainage is the movement of the fluid away from the interior 46 of the structure 42 and toward the exterior 44 of the structure 42, and negative drainage is the movement of the fluid away from the exterior 44 of the structure 42 and toward the interior 46 of the structure 42. When the sill 62 presents the tread surface 84, or when the sill deck 82 presents the tread surface 84, the tread surface 84 is typically sloped downwardly away from the interior side of the sill 62 as described above.

As set forth in the present application, the term drainage typically refers to movement of the fluid, which is typically water. However, it is to be appreciated that the drainage may refer to the movement of any fluid, including any debris that may be entrapped within the fluid. Furthermore, drainage may also refer to the movement of any object that is desired to be removed from the threshold assembly 60.

The tread surface 84 may define a plurality of grooves 86 spaced from and parallel to one another and extending longitudinally along the sill 62, as shown in FIG. 2. The grooves 86 collect and direct fluid, which helps with traction between a person's foot and the tread surface 84 by creating additional contact points and by collecting and removing fluid.

Figure 3:
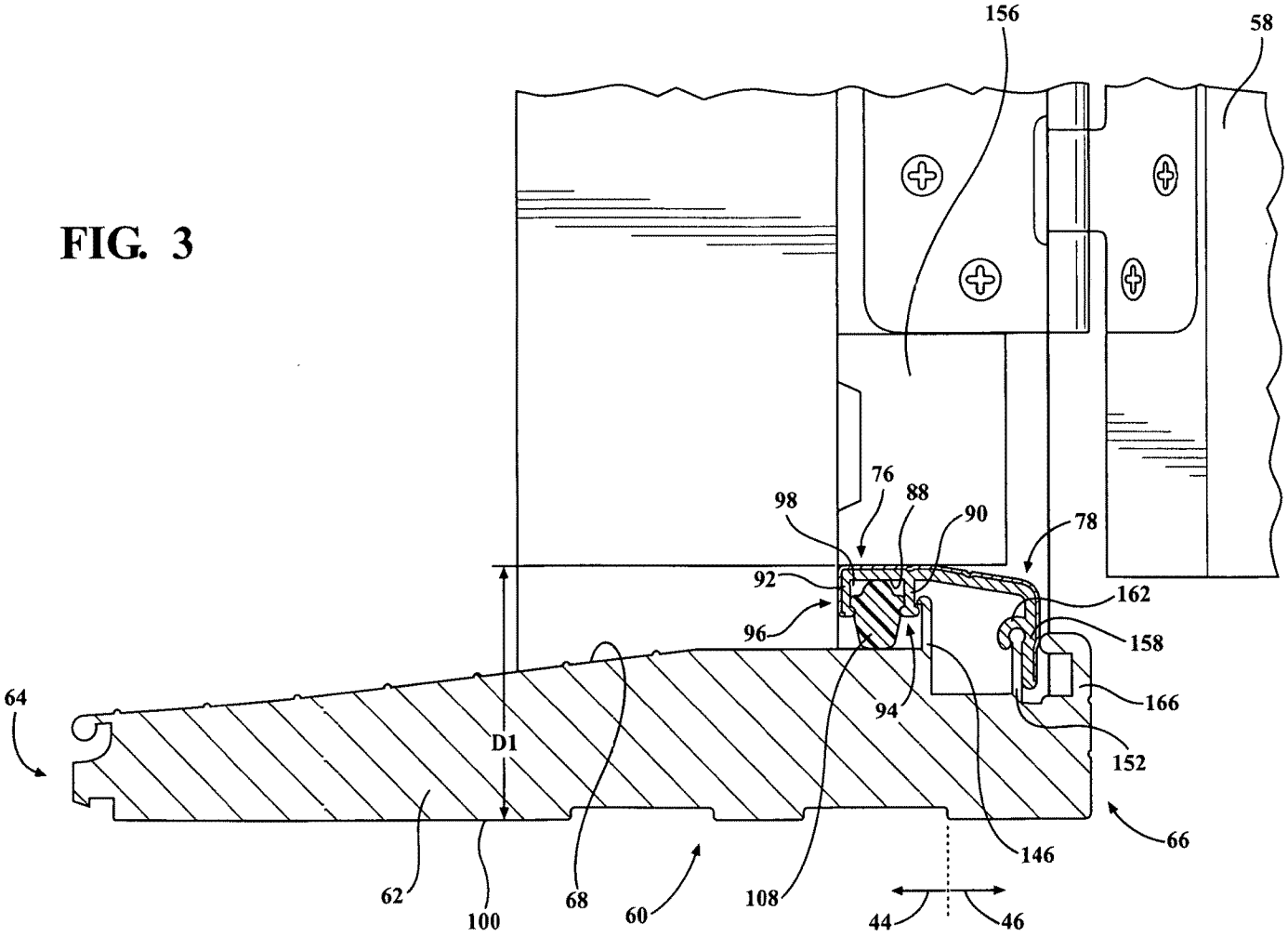
FIG. 3 is a side cross-sectional view of the threshold assembly, the first door jamb of the door frame, and the door panel showing the door panel in an open position and the rail in an initial position.

The threshold assembly 60 also includes a rail 74. The rail 74 is rotatably supported above the upper sill surface 68 of the sill 62. The rail 74 has a leading edge 76 facing the exterior side 64, and has a rear edge 78 facing the interior side 66, as shown in FIG. 3. The rail 74 is movable relative to the upper sill surface 68 between an initial position when the door panel 58 is in the open position, as shown in FIG. 3, and a second position different from the initial position when the door panel 58 is in the closed position, as shown in FIG. 4. This second position is appreciated to be the sealed position. The rear edge 78 is typically coupled to the sill 62. When the rear edge 78 is pivotably coupled to the sill 62, the leading edge 76 pivots with respect to the rear edge 78. As shown in FIGS. 4, 14, and 41-44 when the rear edge 78 is pivotably coupled to the sill 62, the entire rail 74 is rotatably supported above the sill 62, and the entire rail 74 is rotatable between the initial and second positions.

The rail 74 presents a lower rail surface 88 facing the upper sill surface 68. As shown in FIG. 1, the rail 74 may extend between the first and second ends 70, 72 of the sill 62. More specifically, the rail 74 typically extends toward the first and second ends 70, 72 of the sill 62 such that the rail 74 extends along the entire width W of the sill 62. However, it is to be appreciated that the rail 74 may extend along only a portion of the sill 62. It is also to be appreciated that the rail 74 may extend past the first and second ends 70, 72 of the sill 62. The rail 74 is typically spaced from each of the first and second door jambs 50, 52. However, the rail 74 may extend to and contact one or both of the first and second door jambs 50, 52. The door panel 58 engages the rail 74 along the width W of the sill 62 for sealing the opening 54 of the doorframe 48 beneath the door panel 58, as described in further detail below.

As shown in FIGS. 2-27 and 36-38, the rail 74 has first and second retaining arms 90, 92 spaced from one another along the lower rail surface 88. The first retaining arm 90 extends from the lower rail surface 88 toward the upper sill surface 68 to a distal retention end 94 of the first retaining arm 90, and the second retaining arm 92 extends from the lower rail surface 88 toward the upper sill surface 68 to a distal retention end 96 of the second retaining arm 92, as best shown in FIGS. 15-27. The first and second distal retention ends 94, 96 define a retaining width (W1) therebetween.

Figure 33:
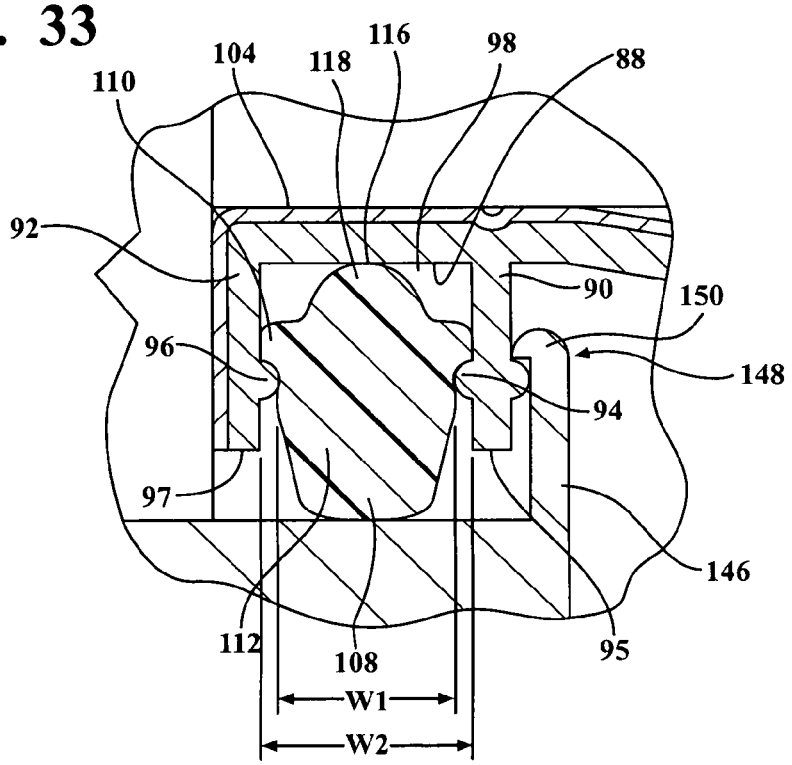
FIG. 33 is a side cross-sectional view of another embodiment of the rail with the biasing member of FIGS. 1-16, 28, 31, and 32.
Figure 34:
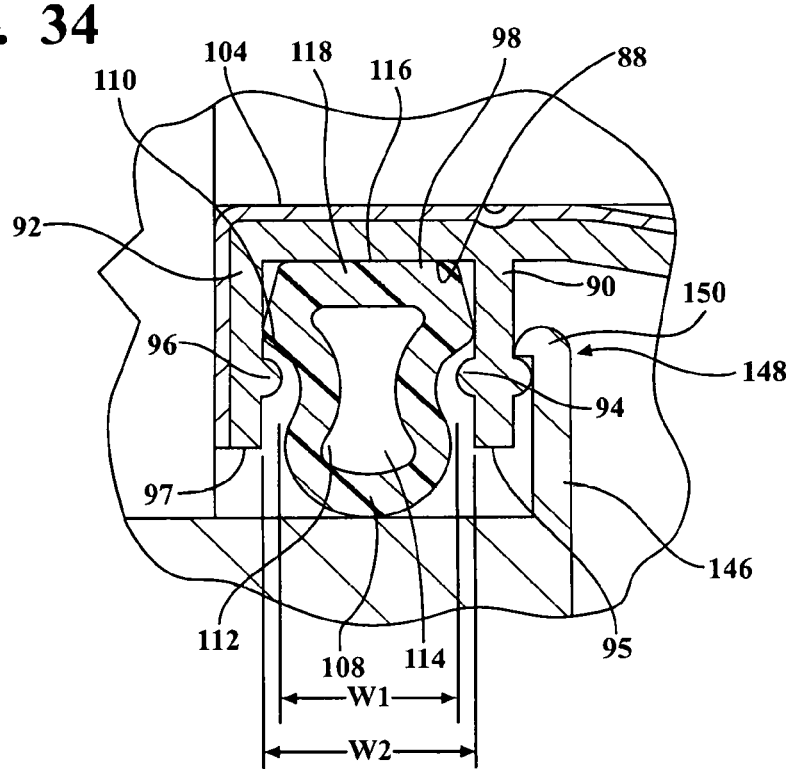
FIG. 34 is a side cross-sectional view of the rail of FIG. 33 with the biasing member of FIGS. 17-19 and 29.
Figure 35:
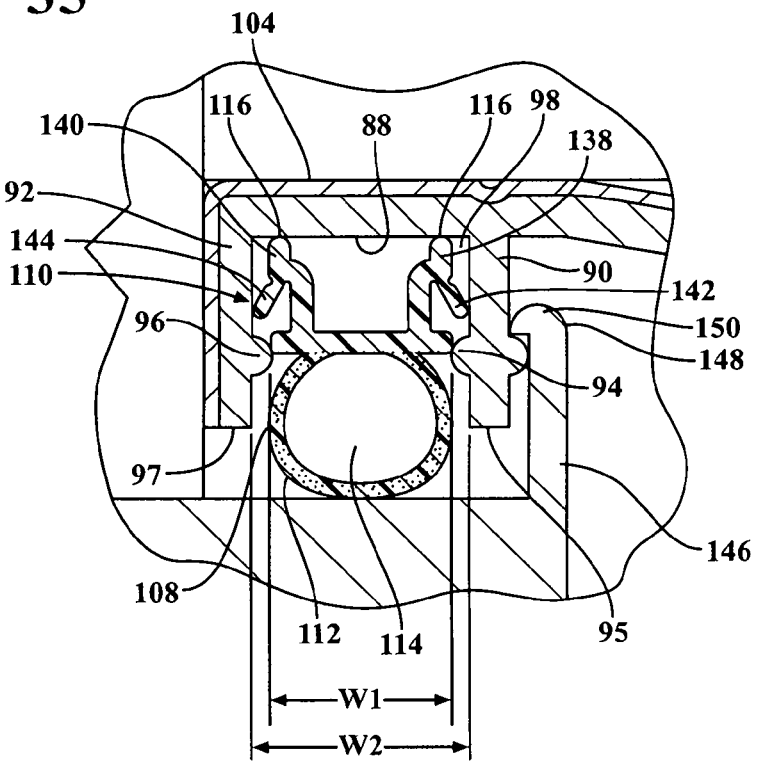
FIG. 35 is a side cross-sectional view of the rail of FIG. 33 with the biasing member of FIGS. 20-27 and 30.
Figure 36:
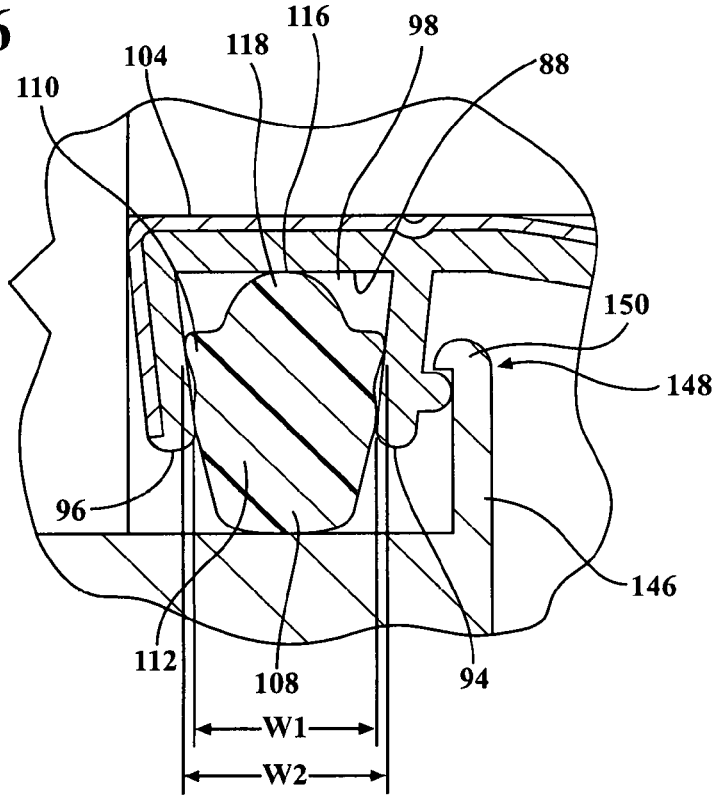
FIG. 36 is a side cross-sectional view of another embodiment of the rail with the biasing member of FIGS. 1-16, 28, and 31-33.
Figure 37:
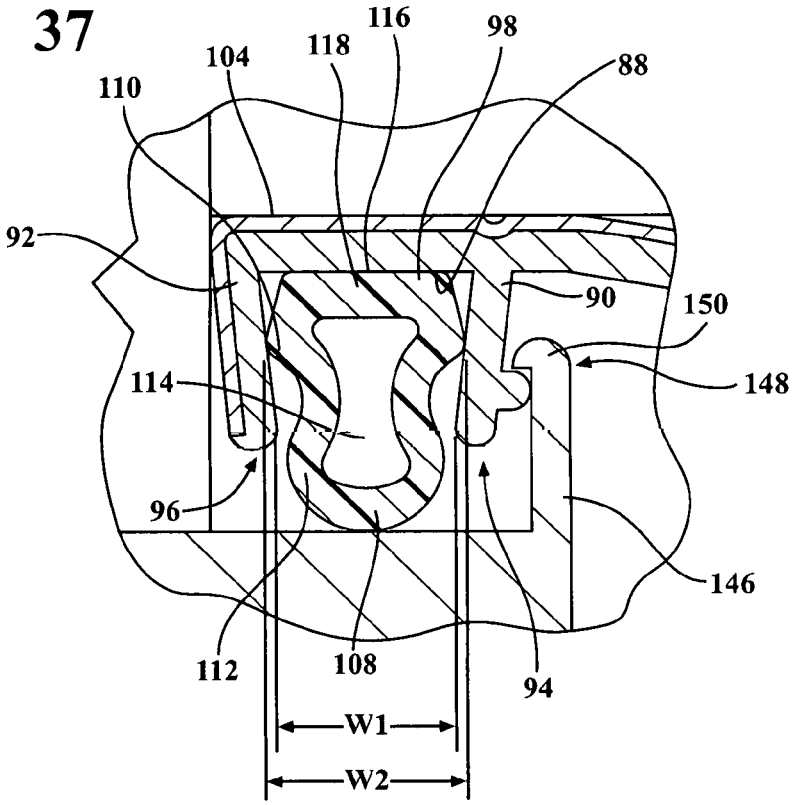
FIG. 37 is a side cross-sectional view of the rail of FIG. 36 with the biasing member of FIGS. 17-19 and 29.
Figure 38:
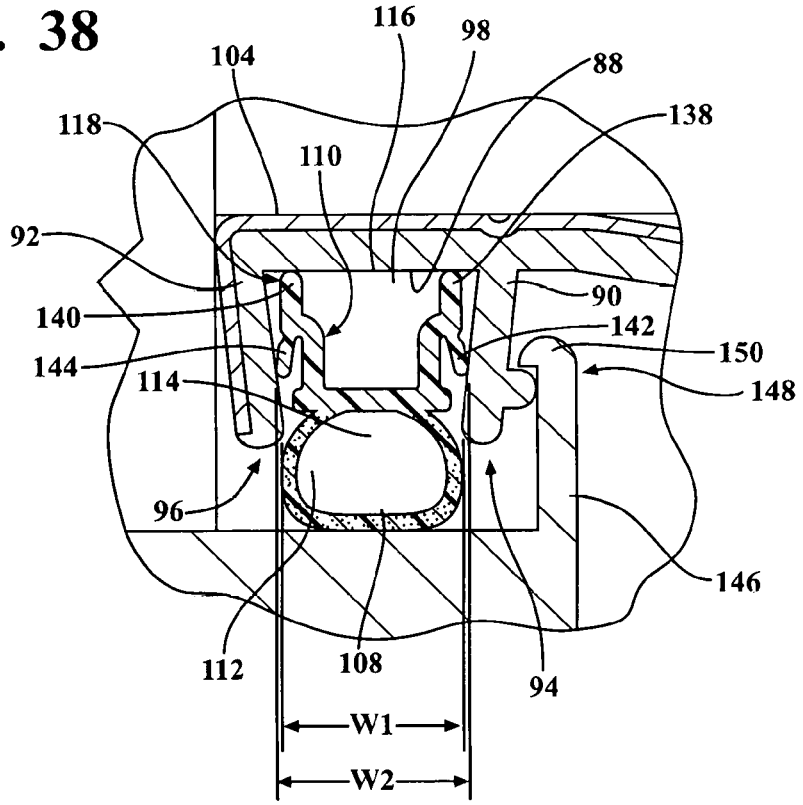
FIG. 38 is a side cross-sectional view of the rail of FIG. 36 with the biasing member of FIGS. 20-27 and 30.
Figure 39:
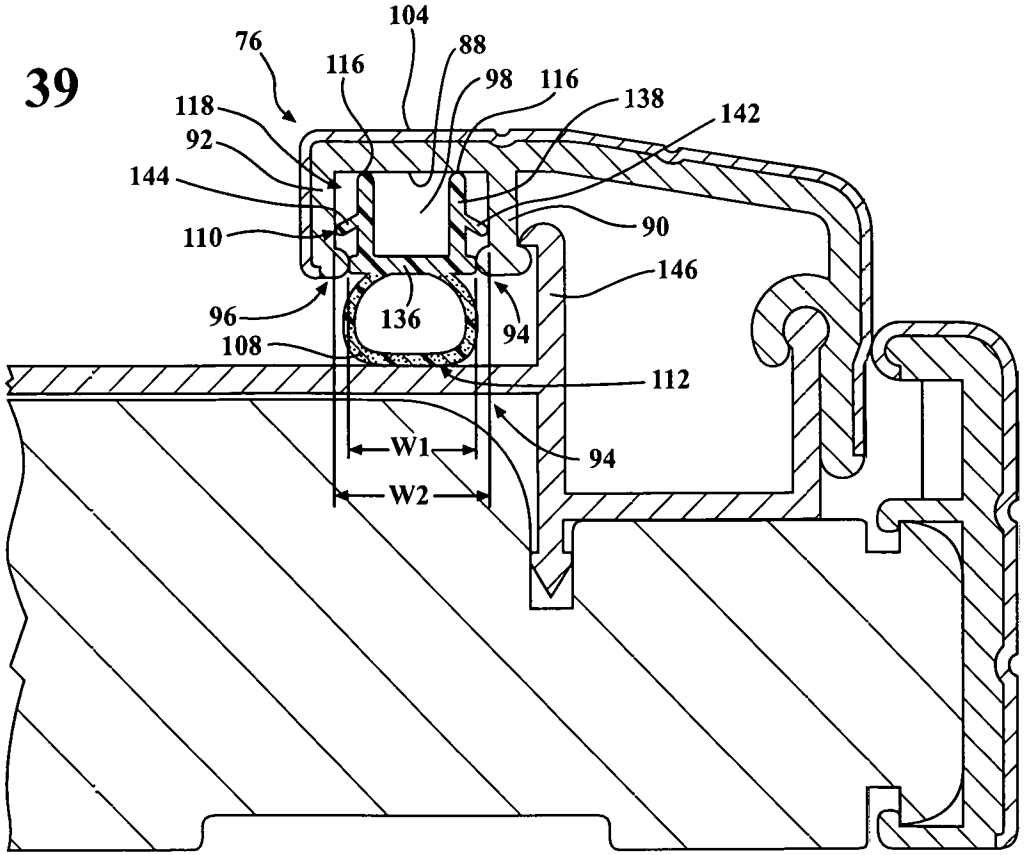
FIG. 39 is a side cross-sectional view another embodiment of the biasing member of FIGS. 20-27, 30, 35, and 38.
Figure 42:
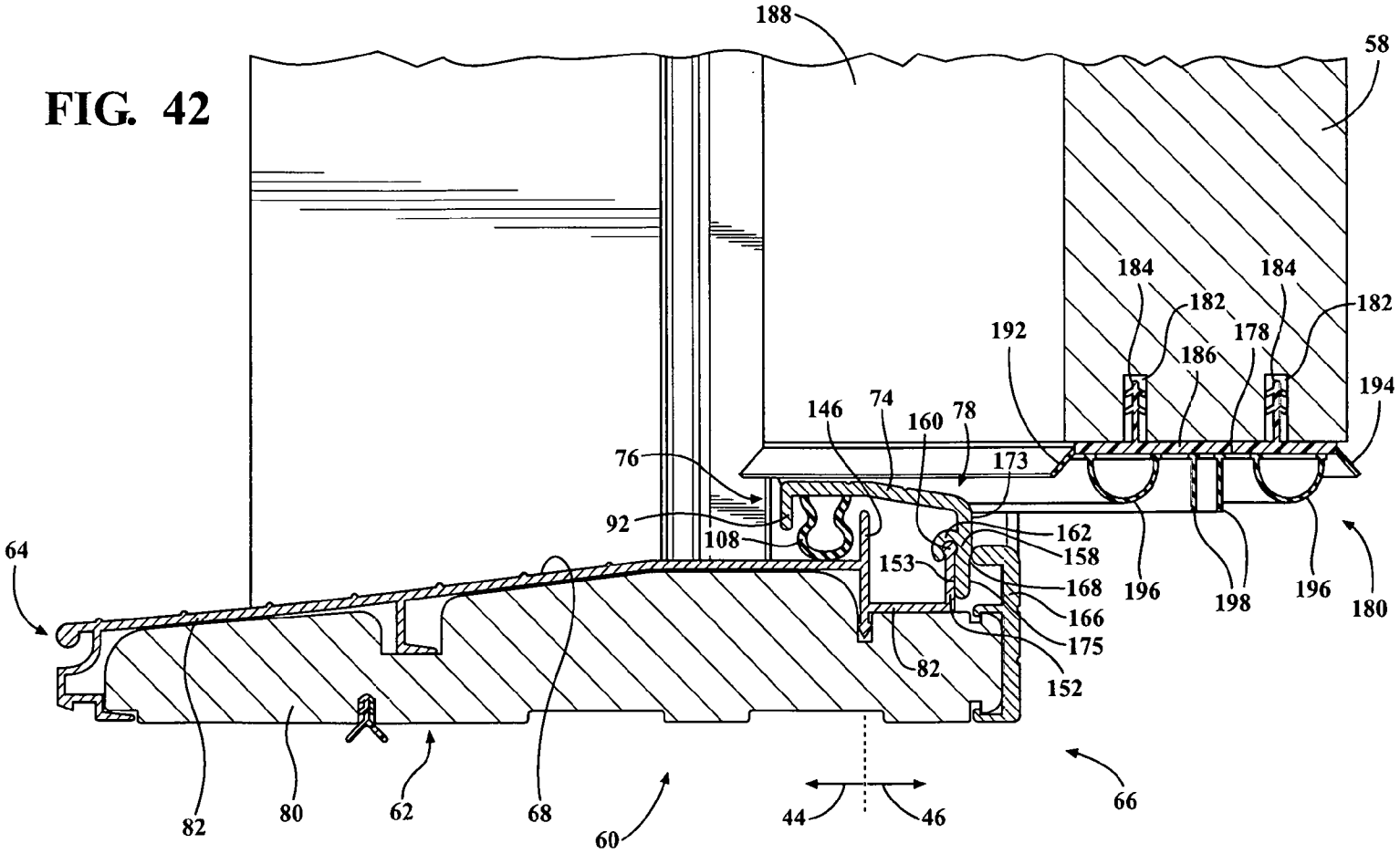
FIG. 42 is a side cross-sectional view of the threshold assembly of FIG. 41 with the first door jamb of the door frame, and the door panel showing the door panel in the open position and the rail in the initial position.
Figure 43:
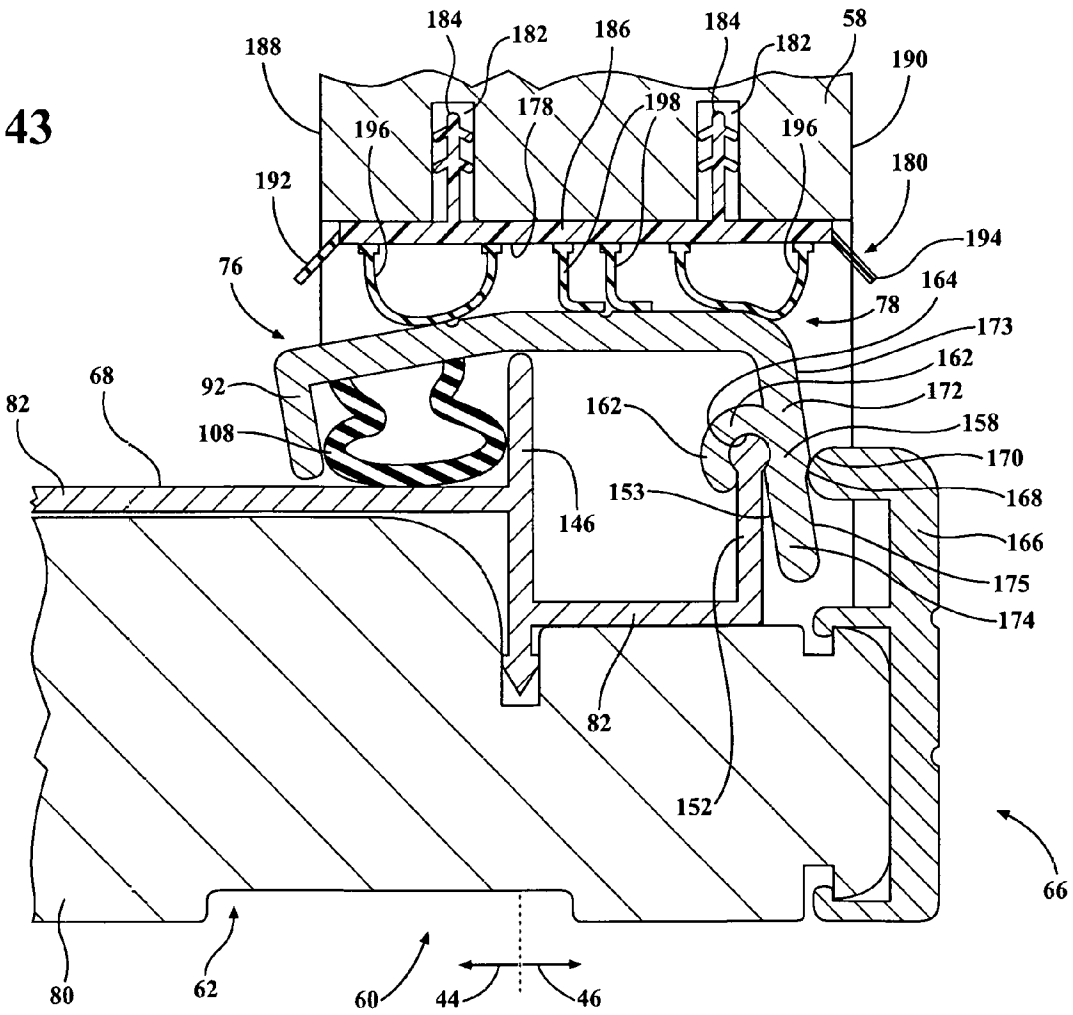
FIG. 43 is a side cross-sectional view of the threshold assembly of FIG. 41, with the first door jamb of the door frame, and the door panel showing the door panel in the closed position and the rail in the second position.
Figure 44:
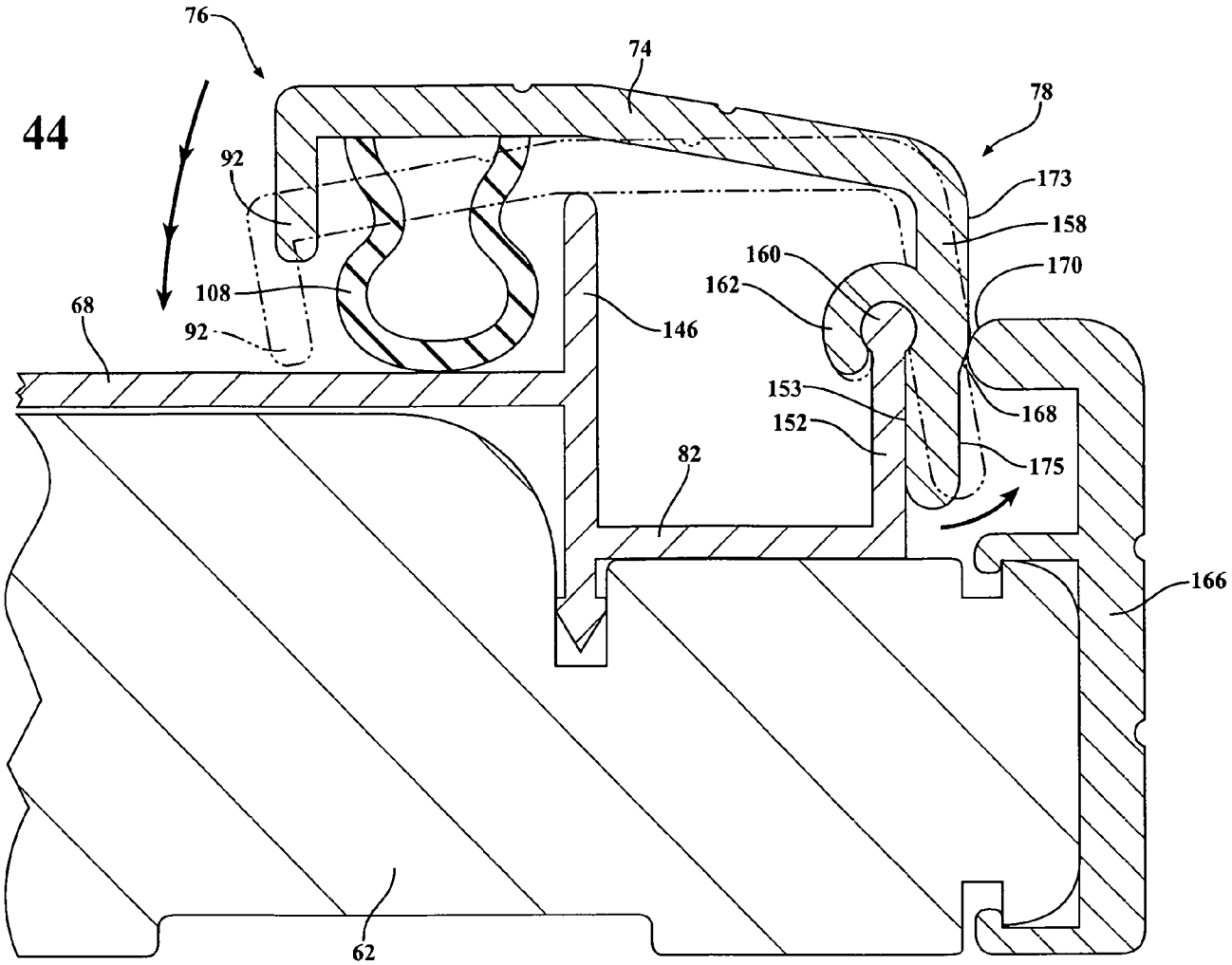
FIG. 44 is a side cross-sectional view of the threshold assembly of FIG. 41, with the rail in the initial position and with the rail in the second position shown in phantom.

In another embodiment, as shown in FIGS. 33-35, the first retaining arm 90 extends from the lower rail surface 88 toward the upper sill surface 68 to a first end 95 adjacent the lower rail surface 88. In this embodiment, the distal retention end 94 of the first retaining arm 90 may extend toward the second retaining arm 92 between the first end 95 and the lower rail surface 88. Likewise, in this embodiment, the second retaining arm 92 extends from the lower rail surface 88 toward the upper sill surface 68 to a second end 97 adjacent the lower rail surface 88. In this embodiment, the distal retention end 96 of the second retaining arm 92 may extend toward the first retaining arm 90 between the second end 97 and the lower rail surface 88. In this embodiment, it is the distal retention end 94 of the first retaining arm 90 and the distal retention end 96 of the second retaining arm 92, as opposed to the first and second ends 95, 97, that define the retaining width (W1) therebetween. It is to be appreciated that the retaining width (W1) may be defined between the first and second retaining arms 90, 92 at any point between the distal retention end 94 and the lower rail surface 88 along the first retaining arm 90 and between the distal retention end 96 and the lower rail surface 88 along the second retaining arm 92. The first retaining arm 90, lower rail surface 88, and second retaining arm 92 collectively define a retention pocket 98. Although the rail 74 is typically comprised of a rigid plastic, it is to be appreciated that the rail 74 may comprise any material of suitable rigidity.

The rail 74 is movable relative to the sill 62 between the initial position having a first distance D1 relative to a bottom sill surface 100 of the sill 62 when the door panel 58 is in the open position, as shown in FIG. 3, and the second position having a second distance D2 relative to the bottom sill surface 100 of the sill 62 when the door panel 58 is in the closed position, as shown in FIG. 4.

As shown in FIG. 4, the rail 74 may define an apex 102. The apex 102 is the largest distance from the bottom sill surface 100 of the sill 62 to an upper rail surface 103 of the rail 74. Specifically, the upper rail surface 103 of the rail 74 may have a primary rail surface 104 and a secondary rail surface 106 adjacent the primary rail surface 104 with the primary rail surface 104 and secondary rail surface 106 extending away from each other from the apex 102.

The primary rail surface 104 typically has a horizontal orientation when the rail 74 is in the initial position, as shown in FIG. 3. The horizontal orientation of the rail 74 facilitates engagement of the door panel 58 with the rail 74 as the door panel 58 moves from the open position to the closed position. With the door panel 58 is in the closed position and the rail 74 is in the second position, as shown in FIG. 4, the primary rail surface 104 slopes away from the interior side 66 of the sill 62 for providing positive drainage off of the rail 74 toward the exterior side 64 of the sill 62. Specifically, the primary rail surface 104 extends from the apex 102 downwardly toward the exterior side 64 of the sill 62. The slope of the primary rail surface 104 promotes positive drainage off of the rail 74 toward the upper sill surface 68.

The secondary rail surface 106 typically slopes away from the exterior side 64 of the sill 62 when the rail 74 is in the initial position, as shown in FIG. 3. With the door panel 58 in the closed position and the rail 74 in the second position, as shown in FIG. 4, the secondary rail surface 106 has a horizontal orientation facilitating abutment of the door panel 58 against the secondary rail surface 106 to seal between the sill 62 and the door panel 58. It is to be appreciated that the primary and secondary surfaces 104, 106 may have any suitable configuration for facilitating sealing against the door panel 58 and positive drainage off of the rail 74 toward the upper sill surface 68.

The first and second distances D1, D2 are measured from the bottom sill surface 100 of the sill 62 to the apex 102 of the rail 74, as shown in the FIGS. 3 and 4. The first distance D1 of the rail 74 in the initial position occurs when the door panel 58 is in the open position. The second distance D2 of the rail 74 in the second position occurs when the door panel 58 is in the closed position. The first distance D1 is greater than the second distance D2 for allowing the rail 74 to adjust closer to the sill 62. The rail 74 adjusts within the entryway system 40. Adjustment of the rail 74 within the entryway system 40 prevents intrusion of the fluid from the exterior 44 of the structure 42 to the interior 46 of the structure 42 by sealing against the door panel 58. More specifically, as the door panel 58 moves from the open position to the closed position, the rail 74 is contacted by the door panel 58 and moves the rail 74 from the initial position toward the sill 62 and into the second position. As such, the threshold assembly 60 is commonly referred to as a self-adjustable threshold assembly in the art. Said differently, the distance D1, D2 is automatically adjusted as the door panel 58 engages the rail 74, which forces the rail 74 toward the sill 62 while the door panel 58 remains in contact with the rail 74 to seal the opening 54. The self-adjustment of the rail 74 will be described in further detail below.

Although not required, the rail 74 is generally rigid and does not bend, flex, or otherwise deform. In certain embodiments, the rail 74 is formed from a rigid material, such as polypropylene. In certain instances, such as when the rigid material is polypropylene, a reinforcing filler is dispersed within the rigid material. In these instances, the rigid material and the reinforcing filler collectively establish the rigidity of the rail 74. In one embodiment, the rail 74 is formed from about 65 to about 90 parts by weight of polypropylene and from about 35 to about 10 parts by weight of calcium carbonate, each based on 100 parts by weight of the rail 74. In another embodiment, the rail 74 is formed from about 75 to about 80 parts by weight of polypropylene and from about 20 to about 25 parts by weight of calcium carbonate, each based on 100 parts by weight of the rail 74.

The threshold assembly 60 further includes a biasing member 108 disposed between the upper sill surface 68 and the lower rail surface 88. The biasing member 108 biases the rail 74 away from the sill 62 and into the initial position. The door panel 58 engages and moves the rail 74 from the initial position, as shown in FIG. 3, to the second position where the biasing member 108 is compressed, as shown in FIG. 4, as the door panel 58 moves from the open position to the closed position. As the door panel 58 disengages the rail 74 and moves from the closed position to the open position, the biasing member 108 biases the rail 74 from the second position and into the initial position. As described above, the threshold assembly 60 may be referred to as a self-adjustable threshold assembly, since the biasing member 108 automatically adjusts the rail 74 toward the door panel 58 for sealing the interior 46 from the exterior 44. It is to be appreciated that the biasing member 108 may be disposed at any point along the lower rail surface 88 for moving the rail 74 between the initial position and the second position.

Figure 16:
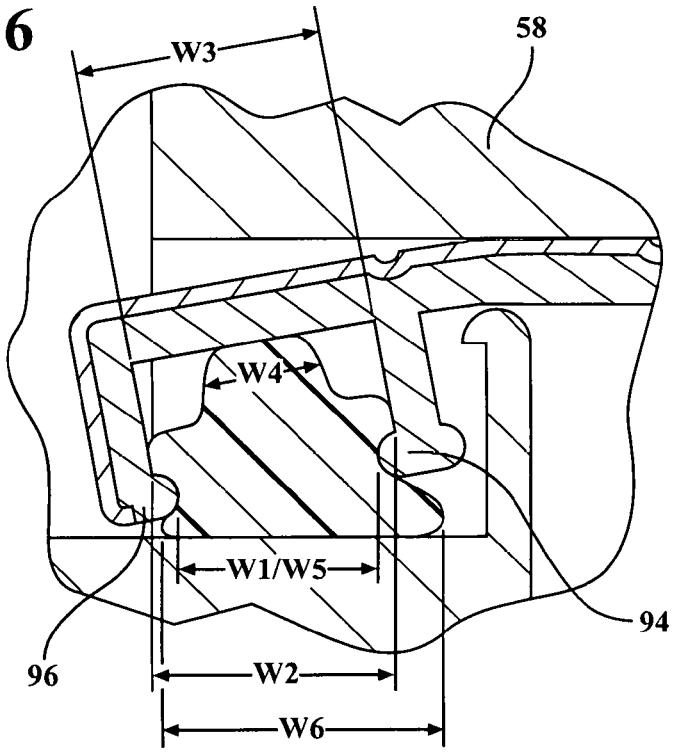
FIG. 16 is an enlarged side cross-sectional view of the rail in the second position.
Figure 17:
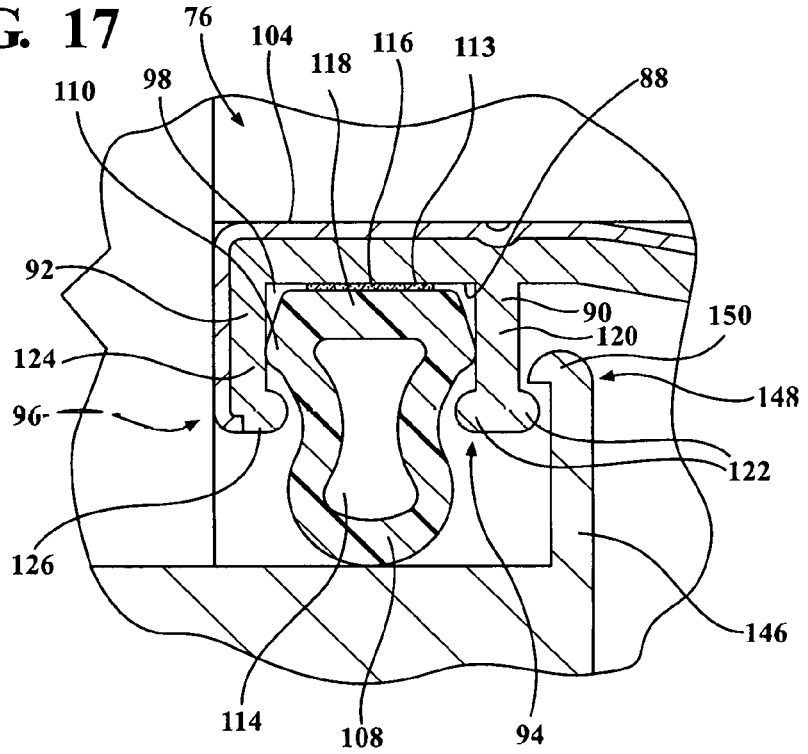
FIG. 17 is an enlarged side cross-sectional view of another embodiment of the biasing member, with the rail in the initial position, and with the threshold assembly having an adhesive between the biasing member and the rail.
Figure 18:
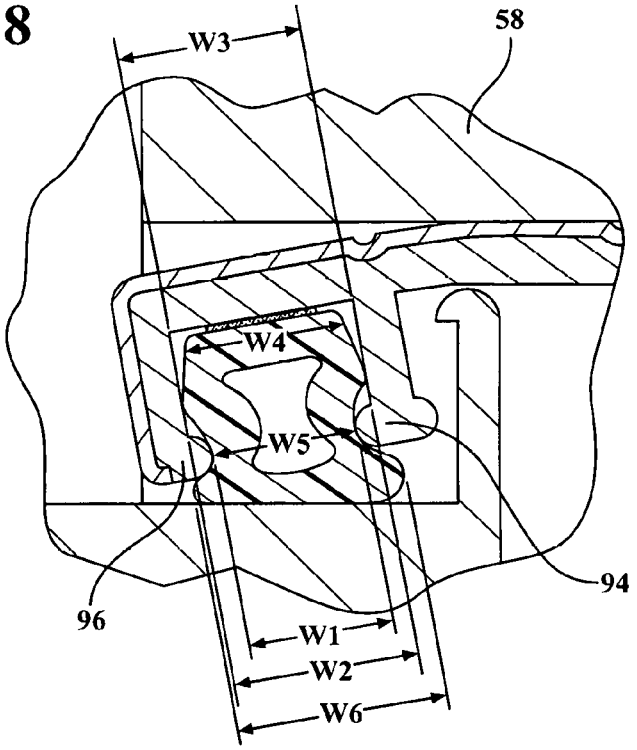
FIG. 18 is an enlarged side cross-sectional view of the biasing member of FIG. 17, with the door panel in the closed position and the rail in the second position.
Figure 19:
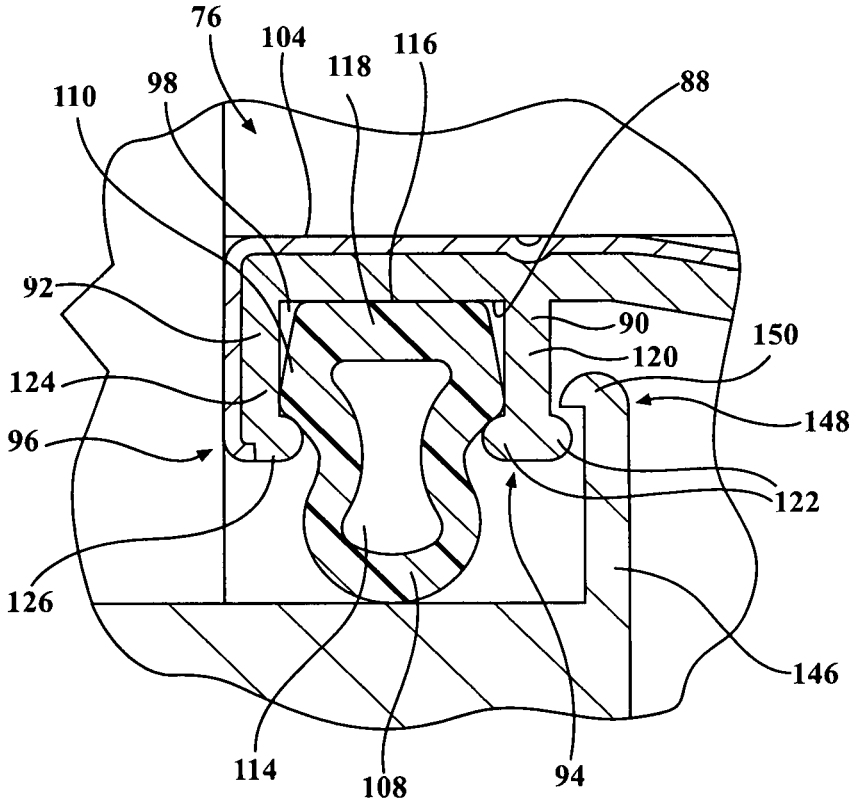
FIG. 19 is an enlarged side cross-sectional view of the biasing member of FIG. 17, with the rail in the initial position, and with the adhesive removed.
Figure 22:
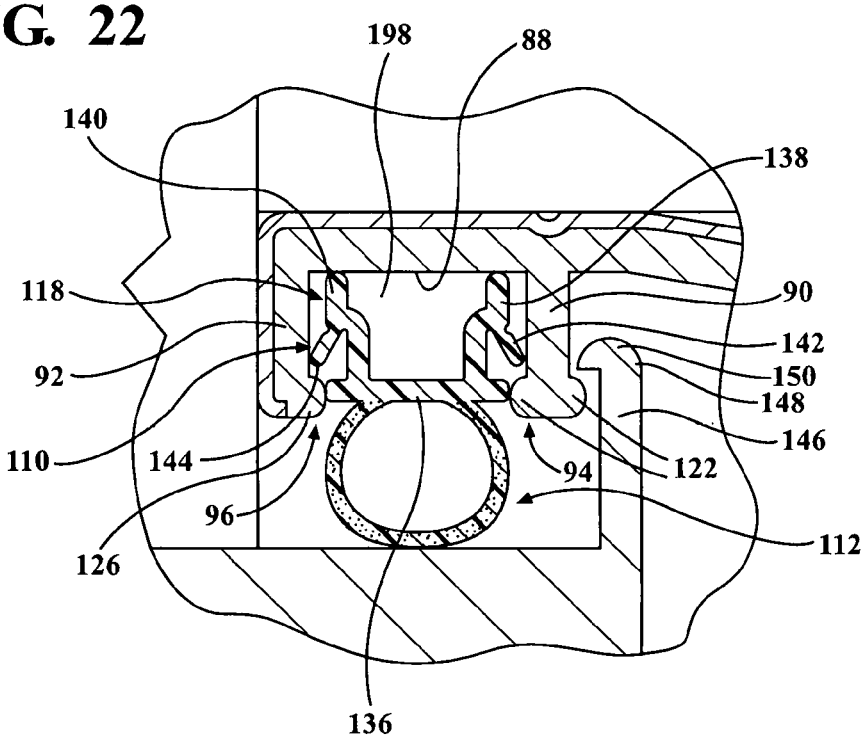
FIG. 22 is an enlarged side cross-sectional view of the biasing member of FIG. 20, with the biasing member in the installed position, and with the rail in the initial position.
Figure 23:
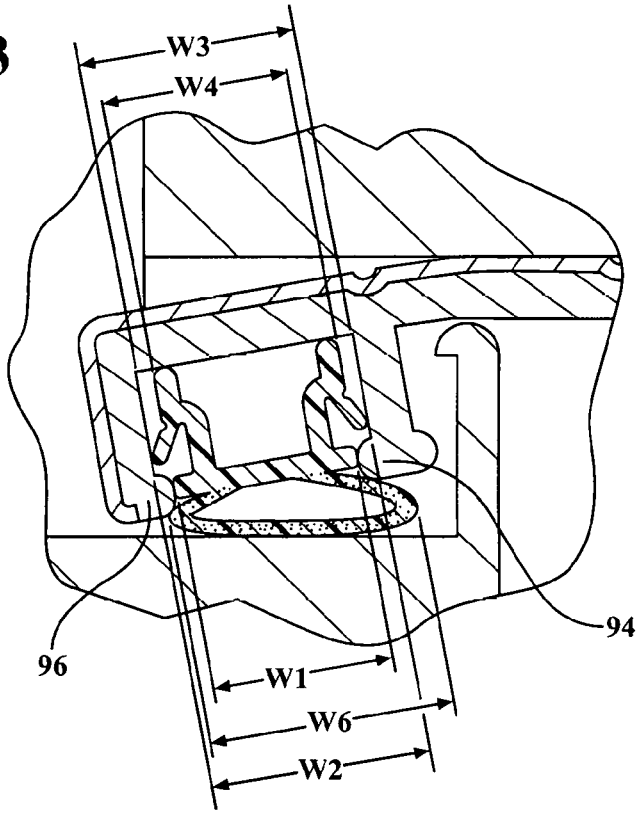
FIG. 23 is an enlarged side cross-sectional view of the biasing member of FIG. 20, with the door panel in the closed position and the rail in the second position.
Figure 24:
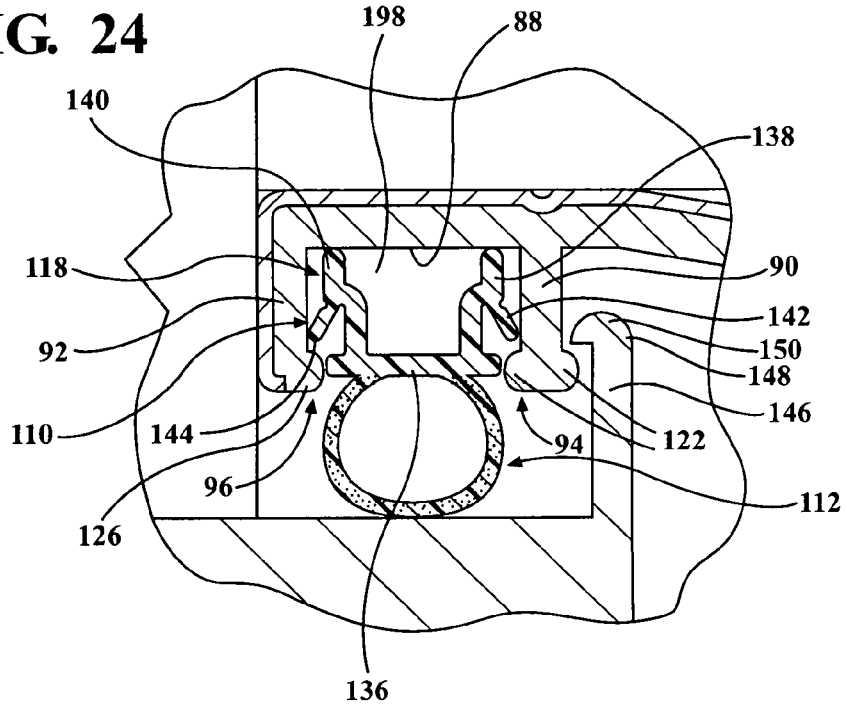
FIG. 24 is an enlarged side cross-sectional view of the biasing member of FIG. 20, with the biasing member having a body member, a first member extending from the body member toward the rail adjacent the first retaining arm, and a second member extending from the body member toward a lower rail surface of the rail adjacent the second retaining arm, with the first member disengaged from the first and second retaining arms, with the first member engaged with the first retaining arm and the lower rail surface, and with the second member engaged with the second retaining arm and the lower rail surface.

The biasing member 108 comprises a first portion 110 disposed within the retention pocket 98, and a second portion disposed between the first portion 110 of the biasing member 108 and the upper sill surface 68, as best shown in FIGS. 15-30. The first portion of the biasing member 108 has a width (W2) greater than the retaining width (W1) defined between the distal retention ends 94, 96 of the first and second retaining arms 90, 92 for retaining the first portion 110 of the biasing member 108 within the retention pocket 98 during movement of the rail 74 between the initial position and the second position. Retention of the first portion 110 of the biasing member 108 within the retention pocket 98 during movement of the rail 74 between the initial position and the second position helps optimize the self-adjustment feature of the rail 74 of the threshold assembly 60. Although not required, the second portion 112 of the biasing member 108 may be continuously engaged with the upper sill surface 68 to accommodate movement of the rail 74 between the initial position and the second position. As shown in FIGS. 16, 18, and 23, the second portion 112 of the biasing member 108 may be expandable to a fourth width (W6) greater than the width (W2). For example, when the second portion 112 of the biasing member 108 is engaged with the upper sill surface 68 and the rail 74 is in the initial position, the second portion 112 of the biasing member 108 expands laterally as the rail 74 moves into the second position, and the second portion 112 of the biasing member 108 remains engaged with the upper sill surface 68 such that there are no gaps between the biasing member 108 and the upper sill surface 68.

Typically, the biasing member 108 is located adjacent the leading edge 76 of the rail 74, with the biasing member 108 disposed between the lower rail surface 88 and the upper sill surface 68. Although not explicitly shown throughout the Figures, the second portion of the biasing member 108 is typically slightly compressed between the upper sill surface 68 and the lower rail surface 88 when the door panel 58 is in the open position, as described in further detail below. In this instance, the bias of the biasing member 108 causes the biasing member 108 to seal between the upper sill surface 68 and the lower rail surface 88 to prevent backflow of fluid into the interior 46 of the structure 42 between the upper sill surface 68 and the lower rail surface 88. The biasing member 108 may also be referred to as a spring seal, since the biasing member 108 may both bias the rail 74 toward the initial position and seal between the upper sill surface 68 and the lower rail surface 88. Also, the biasing member 108 may also be referred to as a dual-purpose biasing member, dual-purpose spring seal, or a dual purpose seal, since the biasing member 108 may bias the rail 74 between the initial position and the second position and also may seal the interior 46 from the exterior 44 by engaging and sealing between the lower rail surface 88 and the upper sill surface 68.

As the rail 74 moves (e.g. rotates) from the initial position toward the second position, as shown in FIGS. 4, 10, 12, 14, 16, 18, 23, and 43 the biasing member 108 may compress such that second portion 112 of the biasing member 108 engages and biases against a greater area of the upper sill surface 68 and the rail 74. In the second position, the engagement of the biasing member 108 with the greater area of the upper sill surface 68 and the rail 74 further seals between the sill 62 and the rail 74 for preventing backflow of the fluid into the interior 46 of the structure 42 between the upper sill surface 68 and the lower rail surface 88. Furthermore, the bias of the biasing member 108 facilitates engagement of the rail 74 with the door panel 58 when the door panel 58 is in the closed position, which seals between the rail 74 and the door panel 58 for preventing backflow of the fluid into the interior 46 of the structure 42 between the rail 74 and the door panel 58.

Typically, the biasing member 108 extends along the rail 74 toward the first and second door jambs 50, 52. The biasing member 108 may be disposed along the entirety of the rail 74 between the upper sill surface 68 and the lower rail surface 88. It is to be appreciated that the biasing member 108 may be disposed along a portion of the rail 74 between the upper sill surface 68 and the lower rail surface 88. Furthermore, the biasing member 108 may be segmented such that the biasing member 108 is disposed along portions of the rail 74 between the upper sill surface 68 and the lower rail surface 88. In other words, there may be more than one biasing member 108 disposed along the rail 74 between the upper sill surface 68 and the lower rail surface 88.

The biasing member 108 may be comprised of an elastomeric material. In one embodiment, the biasing member 108 is comprised of a flexible sponge silicone. In another embodiment, the biasing member 108 is comprised of a thermoplastic elastomer (TPE). The biasing member 108 may be comprised of a material defining cells, also known as a cellular material. In some embodiments, the biasing member 108 is comprised of a dense (i.e., solid) silicone depending on the desired elasticity. It is to be appreciated that the material of the biasing member 108 may be comprised of any other material and is selected based on the desired/suitable flexibility. It is also to be appreciated that the biasing member 108 may be produced and coupled to the rail 74 through a co-extrusion process or any suitable manufacturing process. Furthermore, it is to be appreciated that the biasing member 108 may be coupled to the rail 74 in any suitable manner, such as fasteners, adhesives or adhesive tape 113 (FIGS. 17 and 18), and the like.

In one embodiment, the biasing member 108 defines a hole 114 extending therethrough. The hole 114 is typically defined through the entire biasing member 108. As described above, the material of the biasing member 108 is selected based on the desired/suitable flexibility. As shown in FIG. 40, the hole 114 defined by the biasing member 108 is larger than the hole 114 in FIGS. 17-19, 29, 34, and 37, which, in turn, enables peripheral walls of the (disclosed, but not numbered) biasing member 108 to be thinner. In this instance, a less flexible and more rigid material, such as a dense (i.e., solid) silicone may be used. In some embodiments, as shown in FIGS. 17-27, 29, 30, 34, 35, and 37-40, the second portion 112 of the biasing member 108 partially defines the hole 114 and the first portion 110 of the biasing member 108 further defines the hole 114. It is to be appreciated that the hole 114 may be any configuration, and may not extend through the entire biasing member without departing from the nature of the present invention. The biasing member 108 may be hollow where the hole 114 is commonly referred to as a hollow portion of the biasing member 108.

In one embodiment, the distal retention ends 94, 96 of the first and second retaining arms 90, 92 are equally spaced from the lower rail surface 88 for retaining the first portion 110 of the biasing member 108 within the retention pocket 98 during movement of the rail 74 between the initial position and the second position. When the distal retention ends 94, 96 of the first and second retaining arms 90, 92 are equally spaced from the lower rail surface 88, the first portion 110 of the biasing member 108 is typically centered within the retention pocket 198.

The retention pocket 98 has a pocket width (W3) defined between the first and second retaining arms 90, 92. Although not required, the pocket width (W3) may be greater than the retaining width (W1). When the pocket width (W3) is greater than the retaining width (W1), the first portion 110 of the biasing member 108 may be expandable within the retention pocket 98 as the rail 74 moves between the initial position and the second position. In some embodiments, the pocket width (W3) is equal to the width (W2) of the first portion 110.

In one embodiment, the first and second retaining arms 90, 92 are engaged with the first portion 110 of the biasing member 108 at the width (W2). In this embodiment, the engagement of the first and second retaining arms 90, 92 to biasing member 108 at the width (W2) helps retain the biasing member 108 within the retention pocket 98. Specifically, engagement of the first and second retaining arms 90, 92 to the biasing member 108 at the width (W2) further helps retain the first portion 110 of the biasing member 108 within the retention pocket 98 such that the biasing member 108 does not pull away from the rail 74.

In one embodiment, the first portion 110 of the biasing member 108 presents an upper biasing surface 116 engaged with the lower rail surface 88. Engagement of the upper biasing surface 116 with the lower rail surface 88 moves the rail between the initial position and the second position. More specifically, the upper biasing surface 116 biases against the lower rail surface 88 for moving the rail 74 from the second position when the door panel 58 is in the closed position and engaged with the rail 74 to the initial position when the door panel 58 is in the open position. Further, in this embodiment, the first and second retaining arms 90, 92 may be engaged with the first portion 110 of the biasing member 108 at the width (W2). When the first and second retaining arms 90, 92 are engaged with the biasing member 108 at the width (W2) and the upper biasing surface 116 is engaged with the lower rail surface 88, the first portion 110 of the biasing member 108 is fixed within the retention pocket 98 such that the first portion 110 of the biasing member 108 moves in unison with the rail 74 as the rail 74 moves between the initial position and the second position.

The biasing member 108 may further comprise a third portion 118 disposed between the first portion 110 and the lower rail surface 88. In this embodiment, the third portion 118 has a third width (W4) less than the width (W2). When the third width (W4) is less than the width (W2), the biasing member 108 may expand within the retention pocket 98.

Although not required, the first retaining arm 90 typically comprises a first leg 120 extending from the lower rail surface 88 toward the upper sill surface 68 and a second leg 122 extending transversely from the first leg 120 at the distal retention end 94 of the first retaining arm 90 toward the biasing member 108, as best shown in FIGS. 15-27. The transverse extension of the second leg 122 may be perpendicular (i.e., at a 90° angle) to the first leg 120, as illustrated throughout the FIGS. However, it is to be appreciated that the second leg 122 may still extend transverse from the first leg 120 when extending at an angle greater or less than 90° from the first leg 120. Similarly, the second retaining arm 92 typically comprises a third leg 124 extending from the lower rail surface 88 toward the upper sill surface 68 and a fourth leg 126 extending transversely from the third leg 124 at the distal retention end 96 of the second retaining arm 92 toward the biasing member 108. The transverse extension of the fourth leg 126 may be perpendicular (i.e., at a 90° angle) to the third leg 124, as illustrated throughout the FIGS. However, it is to be appreciated that the fourth leg 126 may still extend transverse from the third leg 124 when extending at an angle greater or less than 90° from the second leg 122. In this embodiment, the second and fourth legs 122, 126 define the retaining width (W1) therebetween. In other words, as shown in FIGS. 15-27, the second and fourth legs 122, 126 define the retaining width (W1) therebetween, which helps further define the retention pocket 98. This allows the first portion 110 to be retained within the retention pocket 98.

Figure 28:
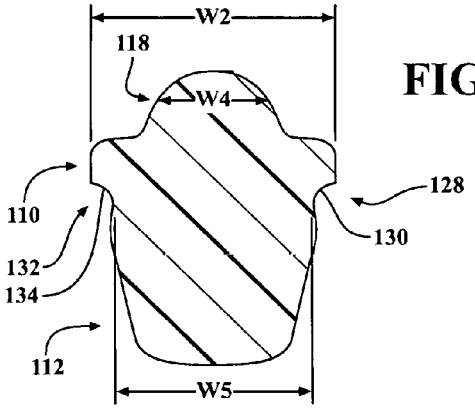
FIG. 28 is a side cross-sectional view of the biasing member of FIGS. 1-16.
Figure 29:
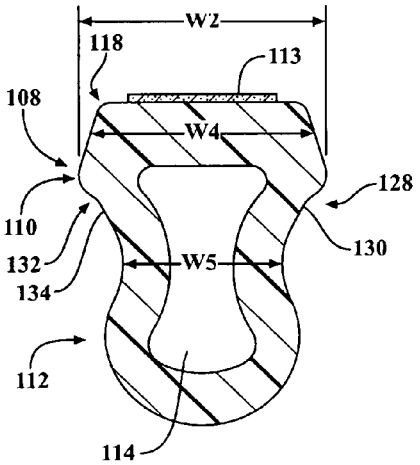
FIG. 29 is a side cross-sectional view of the biasing member of FIGS. 17-19.
Figure 30:
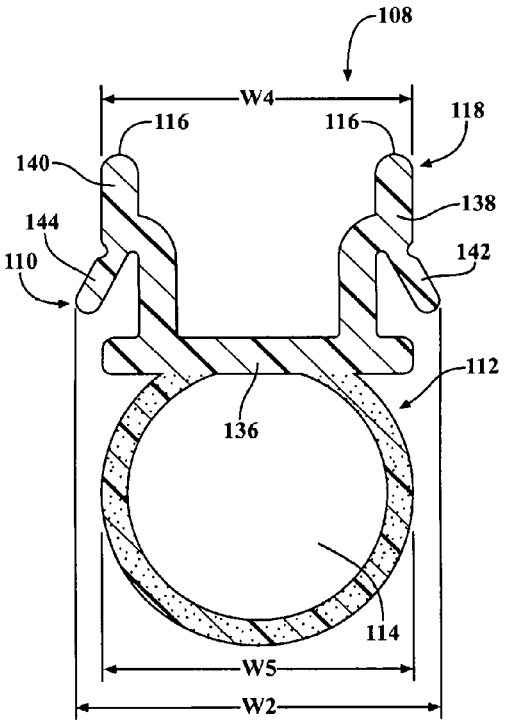
FIG. 30 is a side cross-sectional view of the biasing member of FIGS. 20-27.

As shown in FIGS. 15-19, 28, and 29, the second portion 112 of the biasing member has a second width (W5) less than the width (W2) of the first portion of the biasing member 108. In some embodiments, the second width (W5) is equal to the retaining width (W1). The first and second portions 110, 112 of the biasing member 108 may establish a first stepped configuration 128 having a first underside from the width (W2) to the second width (W5), as shown in FIGS. 28 and 29. The first and second portions 110, 112 may also establish a second stepped configuration 132 having a second underside 134 from the width (W2) to the second width (W5), as shown in FIGS. 28 and 29. In this embodiment, the first retaining arm 90 is engaged with the first underside 130 and the second retaining arm 92 is engaged with the second underside 134. In one embodiment, when the first and second portions 110, 112 of the biasing member 108 establish the first and second stepped configurations 128, 132, the second leg 122 of the first retaining arm 90 is engaged with the first underside 130 and the fourth leg 126 of the second retaining arm 92 is engaged with the second underside 134. It is to be appreciated that the biasing member 108 may only be engaged with the second leg 122 or the fourth leg 126 without departing from the nature of the present invention. Typically, when the second leg 122 is engaged with the first underside 130 and the fourth leg 126 is engaged with the second underside 134, the first leg 120 engages the first portion 110 at the width (W2) and the third leg 124 engages the first portion 110 at the width (W2). It is to be appreciated that the first and second undersides 130, 134 may extend parallel relative to the lower rail surface 88 such that first and second undersides 130, 134 form a shelf with the second and fourth legs 122, 126 engaging the first and second undersides 130, 134. It is to be appreciated that the first and second undersides 130, 134 may extend parallel relative to the lower rail surface 88 such that first and second undersides 130, 134 form a shelf with the second and fourth legs 122, 126 engaging the first and second undersides 130, 134. It is to be appreciated that the first and second undersides 130, 134 may extend parallel relative to the lower rail surface 88 such that first and second undersides 130, 134 form a shelf when the second and fourth legs 122, 126 engage the first and second undersides 130, 134.

Figure 31:
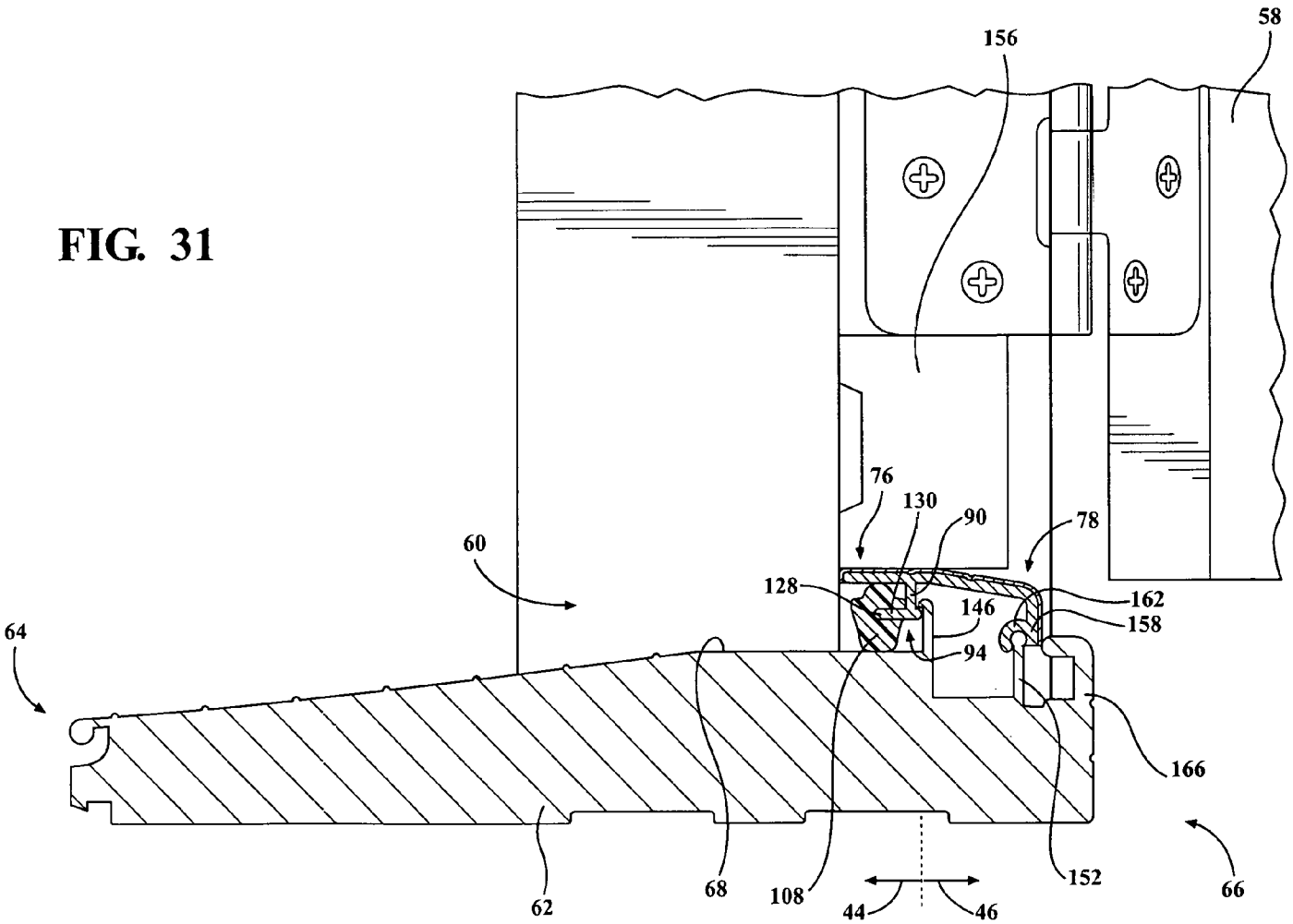
FIG. 31 is a side cross-sectional view of another embodiment of the rail and the biasing member of FIGS. 1-16 and 28.
Figure 32:
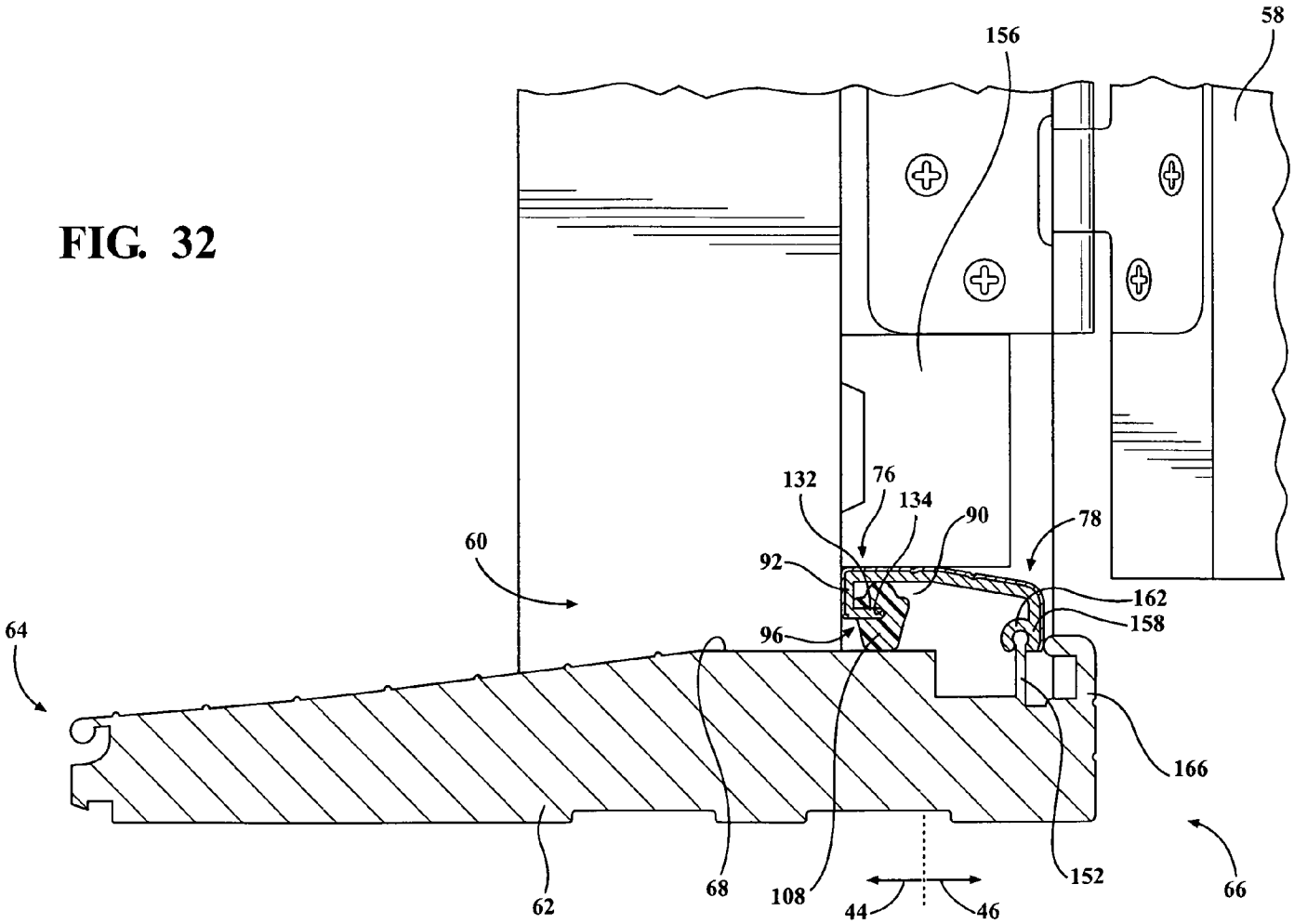
FIG. 32 is a side cross-sectional the rail of FIG. 31 and the biasing member of FIGS. 1-16, 28, and 31.

In one embodiment, as shown in FIGS. 31 and 32, the rail 74 has a single retaining arm extending from the lower rail surface 88 to a distal retention end of the retaining arm. As shown in FIG. 31, the rail 74 has the first retaining arm 90 extending from the lower rail surface 88 to the distal retention end 94 of the first retaining arm 90. In FIG. 31, the first retaining arm 90 is shown as the only retaining arm. The first and second portions 110, 112 of the biasing member 108 establish the first stepped configuration 128 having the first underside 130 from the width (W2) to the second width (W5). The first retaining arm 90 is engaged with the first underside 130 and the upper biasing surface 116 of the third portion 118 of the biasing member 108 is engaged with the lower rail surface 88 for continuously engaging the biasing member 108 to the rail 74 for moving the rail 74 between the initial position and the second position. As shown in FIG. 32, the rail 74 has the second retaining arm 92 extending from the lower rail surface 88 to the distal retention end 96 of the second retaining arm 92. In FIG. 32, the second retaining arm 92 is shown as the only retaining arm. The first and second portions 110, 112 of the biasing member 108 establish the second stepped configuration 132 having the second underside 134 from the width (W2) to the second width (W5). The second retaining arm 92 is engaged with the second underside 134 and the upper biasing surface 116 of the third portion 118 is engaged with the lower rail surface 88 for continuously engaging the biasing member 108 to the rail 74 for moving the rail 74 between the initial position and the second position.

In one embodiment, as shown in FIGS. 20-27, the first portion 110 of the biasing member 108 comprises a body member 136, a first member 138, and a second member 140. In this embodiment, the body member 136 is coupled to the second portion 112 of the biasing member 108, the first member 138 extends from the body member 136 toward the lower rail surface 88 adjacent the first retaining arm 90, and the second member 140 extends from the body member 136 toward the lower rail surface 88 adjacent the second retaining arm 92. In this embodiment, the first and second members 138, 140 also define the width (W2) therebetween.

As shown in FIGS. 20-27, the first member 138 of the first portion 110 of the biasing member 108 comprises a first resilient arm 142 extending from the first member 138 toward the first retaining arm 90, and the second member 140 of the first portion 110 of the biasing member 108 comprises a second resilient arm 144 extending from the second member 140 toward the second retaining arm 92. The first and second resilient arms 142, 144 define the width (W2) therebetween.

In one embodiment, as shown in FIGS. 22-25, the first and second members 138, 140 of the first portion 110 of the biasing member 108 present the upper biasing surface 116 that is engaged with the lower rail surface 88 of the rail 74 for moving the rail 74 between the initial position and the second position. However, it is to be understood that the first and second members 138, 140 of the first portion 110 of the biasing member 108 are not required to engage the lower rail surface 88 of the rail 74, i.e., the first and second members 138, 140 can be spaced from the lower rail surface 88.

In another embodiment, as shown in FIGS. 22-24 and 27, the first resilient arm 142 of the first member 138 of the first portion 110 of the biasing member 108 is engaged with the first retaining arm 90, and the second resilient arm 144 of the second member 140 of the first portion 110 is engaged with the second retaining arm 92.

Figure 25:
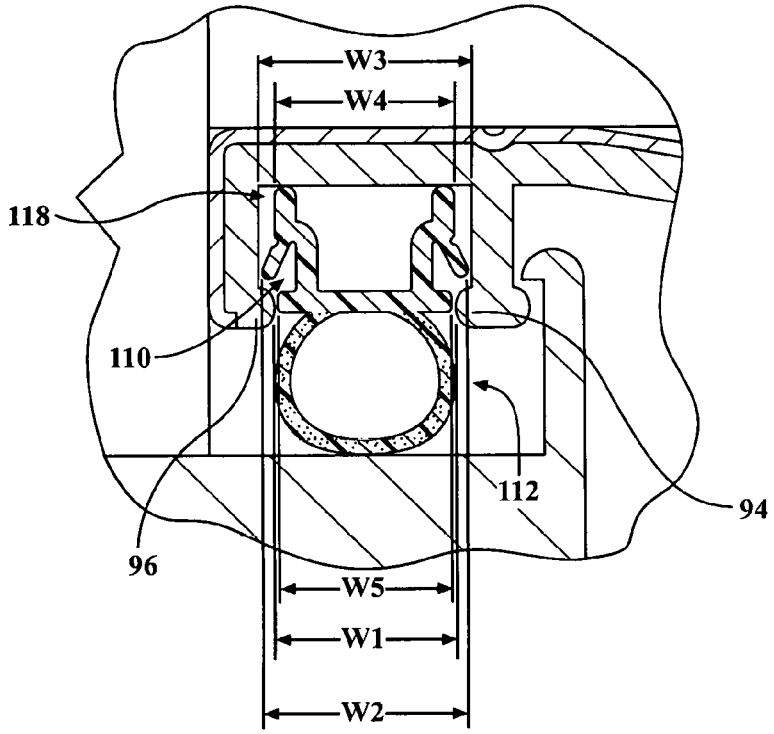
FIG. 25 is an enlarged side cross-sectional view of the biasing member of FIG. 20, with the first member comprising a first resilient arm extending from the first member toward the first retaining arm, with the second member comprising a second resilient arm extending from the second member toward the second retaining arm, with the body member disengaged with the first and second retaining arms, with the first member and the first resilient arms disengaged with the first retaining arm, with the second member and the second resilient arm disengaged with the second retaining arm, and with the first and second members engaged with the lower rail surface.
Figure 26:
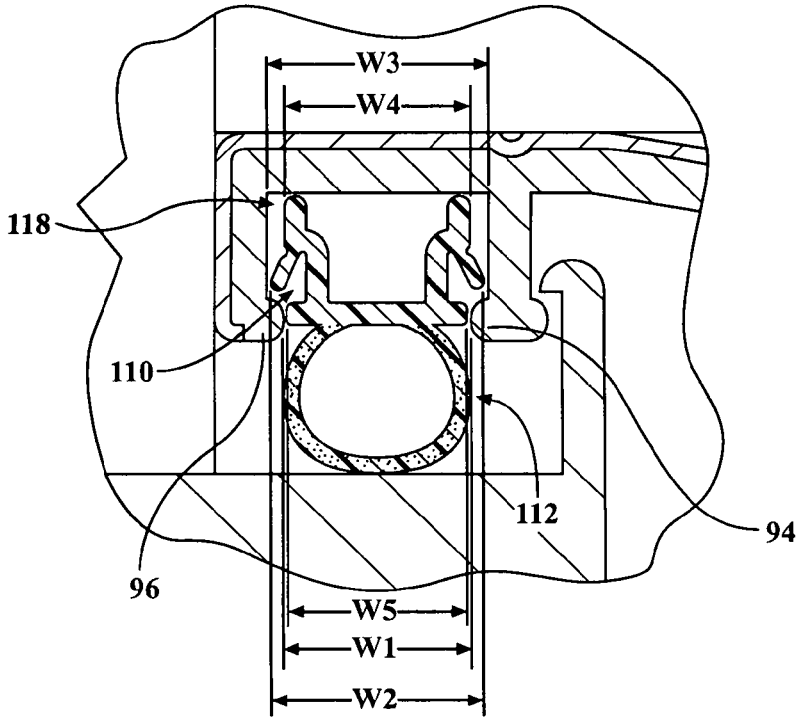
FIG. 26 is an enlarged side cross-sectional view of the biasing member of FIG. 20, with the body portion disengaged with the first and second retaining arms, with the first member disengaged with the first retaining arm and the lower rail surface, and with the second member disengaged with the second retaining arm and the lower rail surface.
Figure 27:
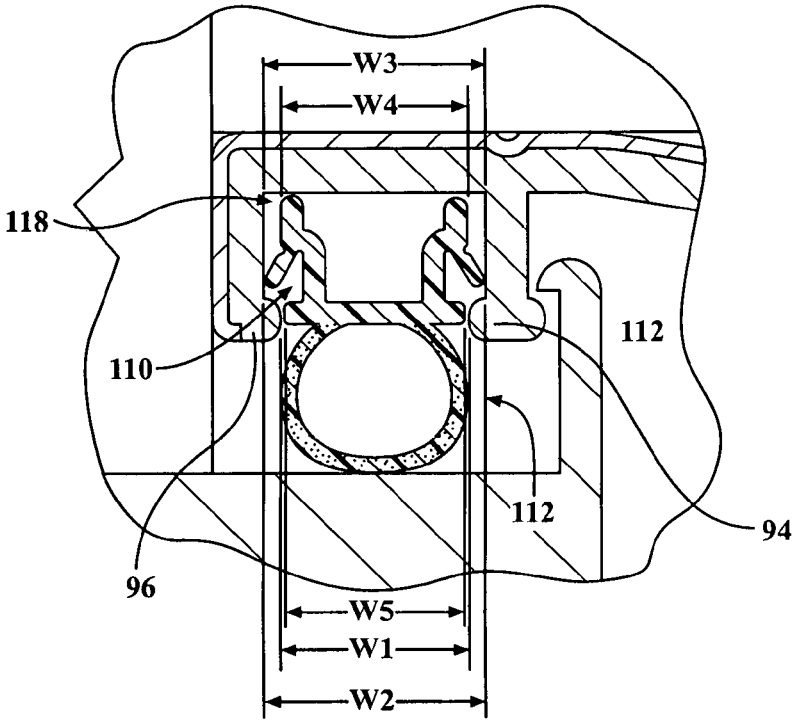
FIG. 27 is an enlarged side cross-sectional view of the biasing member of FIG. 20, with the body portion disengaged with the first and second retaining arms, with the first and second members disengaged from the lower rail surface, and with the first and second resilient arms engaged with the first and second retaining arms, respectively.

It is to be appreciated that the first and second members 138, 140 may be engaged or disengaged with the first and second retaining arms 90, 92, respectively, as shown in FIGS. 25 and 26. In both cases, the width (W2) of the first portion 110 is greater than the retaining width (W1), which retains the first portion 110 of the biasing member 108 within the retention pocket 98. When the first and second members 138, 140 are engaged with first and second retaining arms 90, 92, the first portion 110 of the biasing member 108 is secured within the retention pocket 98 such that the first portion 110 of the biasing member 108 is centered within the retention pocket 98. Likewise, when the first and second members 138, 140 comprise the first and second resilient arms 142, 144, the first and second resilient arms 142, 144 may be engaged or disengaged with the first and second retaining arms 90, 92, respectively. In both cases, the width (W2) defined between the first and second retaining arms 90, 92 is greater than the retaining width (W1), which retains the first portion 110 of the biasing member 108 within the retention pocket 98. When the first and second resilient arms 142, 144 are engaged with first and second retaining arms 90, 92, the first portion 110 of the biasing member 108 is secured within the retention pocket 98 such that the first portion 110 of the biasing member 108 is centered within the retention pocket 98. Although the first and second members 138, 140 are shown extending perpendicularly from the body member 136, parallel to the first and second retaining arms 90, 92 and toward the lower rail surface 88, it is to be appreciated that the first and second members 138, 140 may extend angularly from the body member 136 toward the lower rail surface 88 and toward the first and second retaining arms 90, 92, respectively.

Figure 20:
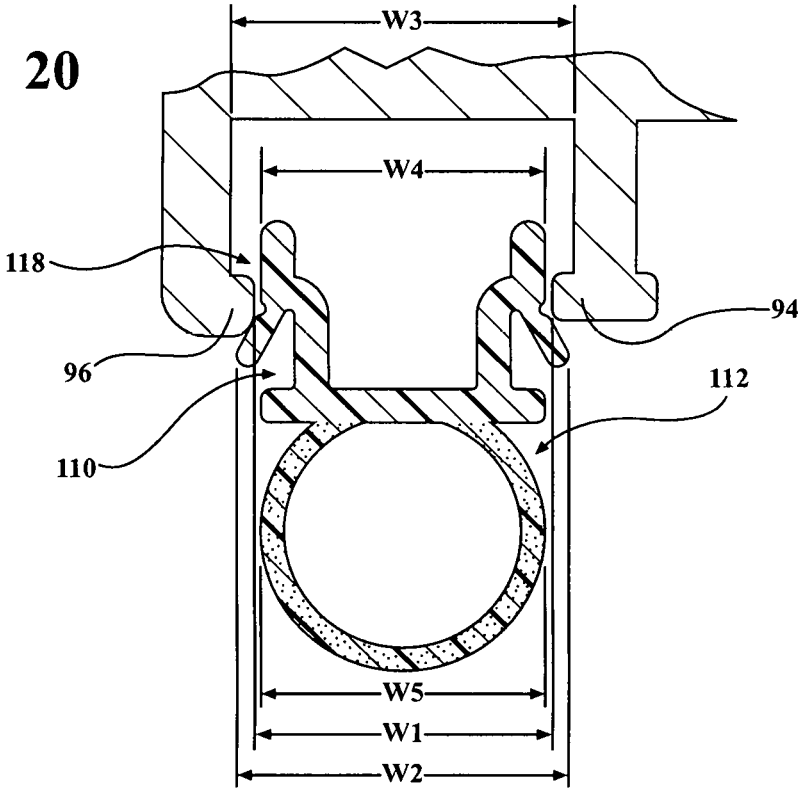
FIG. 20 is an enlarged side cross-sectional view of another embodiment of the biasing member, with the biasing member in an uninstalled position.
Figure 21:
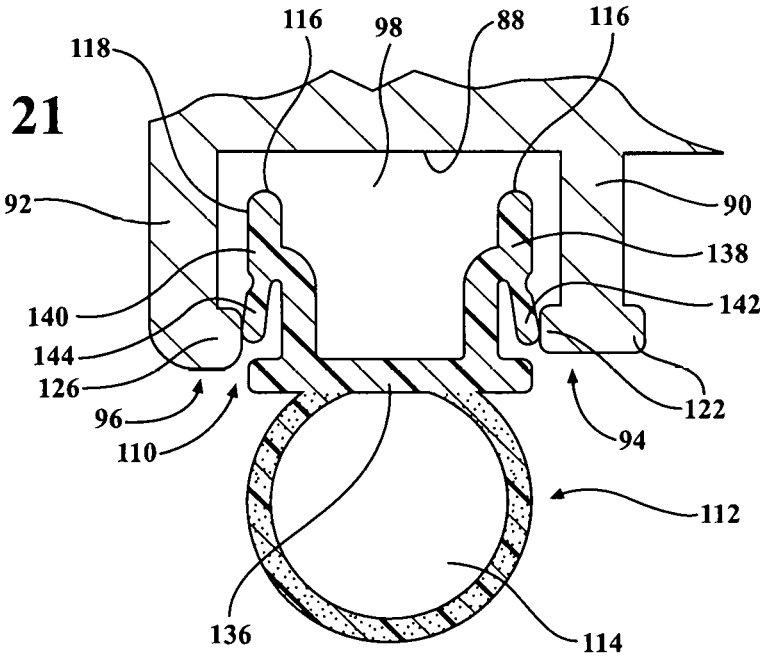
FIG. 21 is an enlarged side cross-sectional view of the biasing member of FIG. 20, with the biasing member moving from the uninstalled position toward an installed position.

The first and second resilient arms 142, 144 help with ease of installation of the biasing member 108. As shown in FIG. 20, the biasing member is in an uninstalled position. As shown in FIG. 21, the biasing member 108 is between the uninstalled position and the installed position, with the first and second resilient arms 142, 144 engaging the first and second retaining arms 90, 92, respectively. As shown in FIG. 22, once in the retention pocket 98, the first and second resilient arms 142, 144 snap outwardly toward the first and second retaining arms 90, 92, respectively, which retains the first portion 110 of the biasing member 108 within the retention pocket 98.

Typically, the body member 136, first member 138, and the second member 140 of the biasing member 108 shown in FIGS. 20-27, 30, 35, 38, and 39 are comprised of a rigid material. The rigid material assists in retaining the first portion 110 of the biasing member 108 within the retention pocket 98 during movement of the rail 74 between the initial position and the second position. Typically, the rigid material is polypropylene; however, it is to be appreciated that the rigid material may be any other material of suitable rigidity may be used.

The second portion 112 of the biasing member 108 shown in FIGS. 20-27, 30, 35, 38, and 39 is typically comprised of an elastomeric material. The elastomeric material biases the rail 74 between the initial position and the second position. Typically, the elastomeric material is a thermoplastic elastomer (TPE) a thermoplastic vulcanizate (TPV), depending on the elasticity desired for the second portion 112. In other embodiments, the second portion 112 of the biasing member 108 is comprised of a TPE, a TPV, a thermoplastic polyamide (TPA), or combinations thereof. In one embodiment, the second portion 112 of the biasing member 108 is comprised of a TPA. In other embodiment, the second portion 112 of the biasing member 108 is comprised of a combination of TPV and TPA. However, it is to be appreciated that the elastomeric material may be any elastomeric material of suitable elastic properties. Suitable elastic properties include resiliency, which is a measure of tendency of the material to deform under a stress and return to an un-deformed state when the stress is removed. When the second portion 112 of the biasing member 108 is comprised of the elastomeric material or any other suitable material, the material of the second portion 112 may be a cellular material. The first and second portions 110, 112 of the biasing member 108 may be co-extruded for integrally forming the biasing member 108. In certain embodiments, the first and second portions 110 and 112 of the biasing member 108 are made of the same material.

In certain embodiments, the body member 136, the first member 138, and the second member 140 of the biasing member 108 are formed from the same material. In these embodiments, the biasing member 108 is made from an elastomeric material. Typically, the elastomeric material is a thermoplastic elastomer (TPE) or a thermoplastic vulcanizate (TPV), depending on the elasticity desired. In other embodiments, the biasing member 108 is comprised of a TPE, a TPV, a (TPA), or combinations thereof. In one embodiment, the biasing member 108 is comprised of a TPA. In other embodiment, the biasing member 108 is comprised of a combination of a TPV and a TPA. However, it is to be appreciated that the elastomeric material may be any elastomeric material having suitable elastic properties. Suitable elastic properties include resiliency, which is a measure of the tendency of the material to deform under a stress and return to an un-deformed state when the stress is removed.

As best shown in FIGS. 3 and 15-27, the sill may have a projection 146 adjacent the first retaining arm 90 with the projection 146 extending from the upper sill surface 68 toward the lower rail surface 88. The first retaining arm 90 may be engageable with the projection 146 for preventing the biasing member 108 from moving (e.g. rotating) the rail 74 beyond the initial position. Although not explicitly shown throughout the FIGS., the second portion 112 of the biasing member 108 is typically slightly compressed, which is caused by the engagement of the first retaining arm 90 to the projection 146, between the upper sill surface 68 and the lower rail surface 88 when the door panel 58 is in the open position. As shown in FIG. 4, the first retaining arm 90 is spaced from the projection 146 when the rail 74 is in the second position, which is a result of the door panel 58 being in the closed position. When the door panel 58 moves from the closed position and into the open position, the biasing member 108 biases the rail 74 toward the initial position. During this movement, the biasing member 108 continues to bias the rail 74 toward the initial position until the first retaining arm 90 engages the projection 146, as shown in FIGS. 2, 3, 5-7, 9, 15, 17, and 22. Moreover, as described above, although the rail 74 typically does not bend, flex, or otherwise deform, in certain embodiments, the rail 74 may bend, flex, or deform with the bending, flexing, or deforming generally occurring in the portion of the rail 74 disposed immediately above the projection 146. In these embodiments, the portion of the rail 74 disposed immediately above the projection 146 may be referred to as a living hinge. It is also to be appreciated that the bending, flexing, or deforming of the rail 74 relative to the living hinge may be such that the leading edge 76 of the rail 74 rotates or pivots relative to the rear edge 78 of the rail 74. Accordingly, in these embodiments, at least a portion of the rail 74 rotates between the initial position and the second position.

As best shown in FIGS. 41-44, in certain embodiments, the rail 74 does not include the first retaining arm 90. Accordingly, in these embodiments, the biasing member 108 is not secured to the rail 74 between the first and second retaining arms (90, 92). Instead, the biasing member 108 is attached to the rail 74 with an adhesive or another suitable means. For example, the biasing member 108 may be coextruded with the rail 74 such that the biasing member 108 is integral with the rail 74 without the need for an adhesive. In certain embodiments, when the rail 74 and the biasing member 108 are coextruded, the rail 74 is formed from polypropylene filled with calcium carbonate and the biasing member 108 is formed from a TPV, a TPA, or a combination thereof. Although not required, when the rail 74 does not include the first retaining arm 90, the projection 146 generally does not engage with rail 74 to prevent the rail 74 from moving beyond the initial position.

Along with preventing movement of the rail 74 beyond the initial position, the projection 146 prevents backflow toward the interior side 66 of the sill 62. As set forth in the present application, the term "backflow" refers to a type of negative drainage. As an example, backflow is when the fluid is forced from the exterior side 64 of the sill 62 toward the interior side 66 of the sill 62. Such backflow may occur due to wind forcing the fluid up the upper sill surface 68. The projection 146 may be integrally formed with the sill 62, may be a separate component of the threshold assembly 60, or may be a component of the sill deck 82. Typically, the projection 146 extends longitudinally between the first and second door jambs 50, 52, and extends away from the upper sill surface 68 to the lower rail surface 88. As such, the projection 146 acts to block backflow of the fluid across the upper sill surface 68 and into the interior 46 of the structure 42.

In one embodiment, to further prevent the biasing member 108 from moving the rail 74 beyond the initial position, the first retaining arm 90 comprises the first leg 120 with the first leg 120 extending from the lower rail surface 88 toward the upper sill surface 68 and the second leg 122 extending transversely from the first leg 120 at the distal retention end 94 of the first retaining arm 90 toward the projection 146. In this embodiment, the projection 146 extends to a projection terminal end 148 defining a hook 150, as shown in FIGS. 15-27. The second leg 122 is engageable with the hook 150 for preventing the biasing member 108 from moving the rail 74 beyond the initial position. In this embodiment, the second leg 122 may also extend transversely from the first leg 120 toward the biasing member 108 at the distal retention end 94 of the first retaining arm 90. The second leg 122 also extending transversely from the first leg 120 toward the biasing member 108 helps to retain the first portion 110 of the biasing member 108 within the retention pocket 98 as the door panel 58 moves from the open position to the closed position, which moves the rail 74 between the initial position and the second position. In this embodiment, the second retaining arm 92 may comprise the third leg 124 extending from the lower rail surface 88 toward the upper sill surface 68, and the fourth leg 126 extending transversely from the third leg 124 at the distal retention end 96 of the second retaining arm 92 toward the biasing member 108. As described above, the second and fourth legs 122, 126 help retain the first portion 110 of the biasing member 108 within the retention pocket 98 during movement of the rail 74 between the initial position and the second position. Further, in this embodiment and as shown in FIGS. 15-19, the biasing member 108 may establish the first and second undersides 130, 134 with the second leg 122 engaged with the first underside 130 and the fourth leg 126 engaged with the second underside 134. As described above, the second leg 122 of the first retaining arm 90 and the fourth leg 126 of the second retaining arm 92 may extend parallel to and equally spaced from the lower rail surface 88. It is to be appreciated that the projection 146 and the first retaining arm 90 and, more specifically, the first and second legs 120, 122, may have any configuration for engaging one another and preventing further movement of the rail 74 beyond the initial position.

The sill 62 may have a protrusion 152 disposed adjacent the interior side of the sill 62, as shown in FIG. 3. The protrusion 152 extends from the upper sill surface 68 toward the lower rail surface 88 to a protrusion terminal end 154, as shown in FIG. 4. The rail 74 may be pivotably coupled to and/or rotatably supported above the protrusion terminal end 154 such that the leading edge 76 of the rail 74 is moveable between the initial position and the second position. It is to be appreciated that movable between the initial position and the second position includes rotating between the initial position and the second position. It is to be further appreciated that the protrusion 152 may be a separate component from the sill 62, or that the protrusion 152 may be a component of the sill deck 82. The protrusion 152 and the projection 146 typically extend substantially parallel to one another.

When the rail 74 is pivotably coupled to and/or rotatably supported above the protrusion terminal end 154, the biasing member 108 may be disposed between the lower rail surface 88 and the upper sill surface 68 adjacent the leading edge 76 of the rail 74. Placement of the biasing member 108 adjacent the leading edge 76 of the rail 74 and spaced from the protrusion terminal end 154 increases resiliency of the rail 74 because the biasing member 108 may provide secondary biasing of the rail 74 toward the initial position. Said differently, the biasing member 108 may further bias the rail 74 in conjunction with any internal biasing (memory) of the rail 74, which would typically result from the material of construct for the rail 74. Additionally, positioning of the biasing member 108 beneath the door panel 58 when the door panel 58 is in the closed position limits a generation of a moment force within the biasing member 108 and thereby increases a resiliency of the biasing member 108. Limiting the moment force acting on the biasing member 108 maintains the elasticity of the biasing member 108.

As described above, the rail 74 is typically spaced from both of the first and second door jambs 50, 52. As shown in FIG. 2, although not required, the entryway system 40 may include a pair of cornerpads 156 individually disposed on the door jambs 50, 52 adjacent the first and second ends 70, 72 of the sill 62 and abutting the rail 74 for sealing the opening 54 of the doorframe 48 between the door jambs 50, 52 and the rail 74. Each of the cornerpads 156 independently abuts one of the door jambs 50, 52 and the rail 74 to seal between the rail 74 and the door jambs 50, 52 and further prevents intrusion of the fluid into the interior 46 of the structure 42.

If utilized, each of the cornerpads 156 typically has a wedge configuration such that the cornerpads 156 extend further away from the door jambs 50, 52 toward the exterior 44 of the structure 42. As such, the rail 74 engages a portion of each of the cornerpads 156 adjacent to the exterior side 64 of the sill 62. The cornerpads 156 elastically deform between the rail 74 and the door jambs 50, 52 creating a seal that further prevents intrusion of fluid or debris into the interior 46 of the structure 42 between the rail 74 and the door jambs 50, 52.

The rail 74 may have a rear extension 158 extending toward the upper sill surface 68. The rear extension 158 may be engageable with the protrusion 152 of the sill 62 for preventing the biasing member 108 from biasing the leading edge 76 to pivot beyond the initial position, as shown in FIGS. 3 and 4. Typically, the rear extension 158 is parallel to the protrusion 152 when the rail 74 is in the initial position. The protrusion terminal end 154 may define a bulb tip 160, and the rear extension 158 may have a protuberance 162 extending from the rear extension 158 toward the biasing member 108, as best shown in FIG. 4. The protuberance 162 defines a channel 164, with the protuberance 162 partially surrounding and configured to receive the bulb tip 160 within the channel 164. The protuberance 162 is rotatable about the bulb tip 160 to accommodate movement of the leading edge 76 between the initial position and the second position. The engagement of the protuberance 162 and the protrusion 152 is similar to that of a cylindrical joint with the bulb tip 160 of the protrusion 152 functioning much like a pin of the cylindrical joint and the protuberance 162 sliding about the protrusion 152. Although the protuberance 162 is shown wrapped around the bulb tip 160 in the Figures, it is to be appreciated that the protuberance 162 and bulb tip 160 may have any other suitable configuration to facilitate sliding of the protuberance 162 relative to the protrusion 152, such as the protuberance 162 having an angular configuration defining a corner with the protrusion 152 engaging the corner of the protuberance 162 and pivoting about the corner.

The rear extension 158 typically moves with the rail 74 as the rail 74 moves between the initial position and the second position. More specifically, the rear extension 158 typically pivots with the rail 74 as the rail 74 pivots between the initial position and the second position.

With reference to FIG. 4, the threshold assembly 60 may further comprise a nosing 166 disposed adjacent the interior side 66 of the sill 62. The nosing 166 defines a rounded corner 170 engaging the rear extension 158. The rear extension 158 may be pivotable about the rounded corner 170 of the nosing 166. The rear edge 78 may comprise a hinge portion 172 extending from the lower rail surface 88 and an engagement portion 174 adjacent the sill 62. The rear edge 78 may define a transition surface 168 between the hinge portion 172 and the engagement portion 174, with the transition surface 168 rotatable about the rounded corner 170. In particular, in certain embodiments as best shown in FIGS. 8, 10, and 41-44, the rear extension 158 includes a first surface 173 and the engagement portion 174 includes a second surface 175, with both the first surface 173 and second surface 175 facing the nosing 166. The transition surface 168 connects the first and second surfaces 173, 175 with the transition surface 168 being transverse to, the first and second surfaces 173, 175. In other words, the transition surface 168 has an angular configuration such that the engagement portion 174 is shifted (i.e., offset) from linear alignment with the hinge portion 172. In certain embodiments, the first surface 173 and the second surface 175 are parallel to each other with the transition surface 168 connecting, and being transverse, to the first and second surfaces 173, 175 due to the transition surface having an angular configuration. The transition surface 168 engages and is rotatable about the rounded corner 170 of the nosing 166. The angular configuration of the transition surface 168 from the engagement portion 174 of the rear extension 158 to the hinge portion 172 of the rear extension 158 allows the rail 74 to move between the initial and second positions (shown in FIGS. 3 and 4, respectively) without the rail 74 binding against the nosing 166. Furthermore, the transition surface 168 may remain engaged with the nosing 166 during movement of the rail 74 between the initial position and the second position. It is to be appreciated that the transition surface 168 may have any configuration for preventing the rear extension 158 from binding against the nosing 166, such as an arcuate configuration. In instances where the transition surface 168 has the arcuate configuration, the first and second surfaces 173, 175 may also have an arcuate configuration provided the arcuate configuration of the transition surface 168 is different than the arcuate configuration of the first and second surfaces 173, 175.

Figure 7:
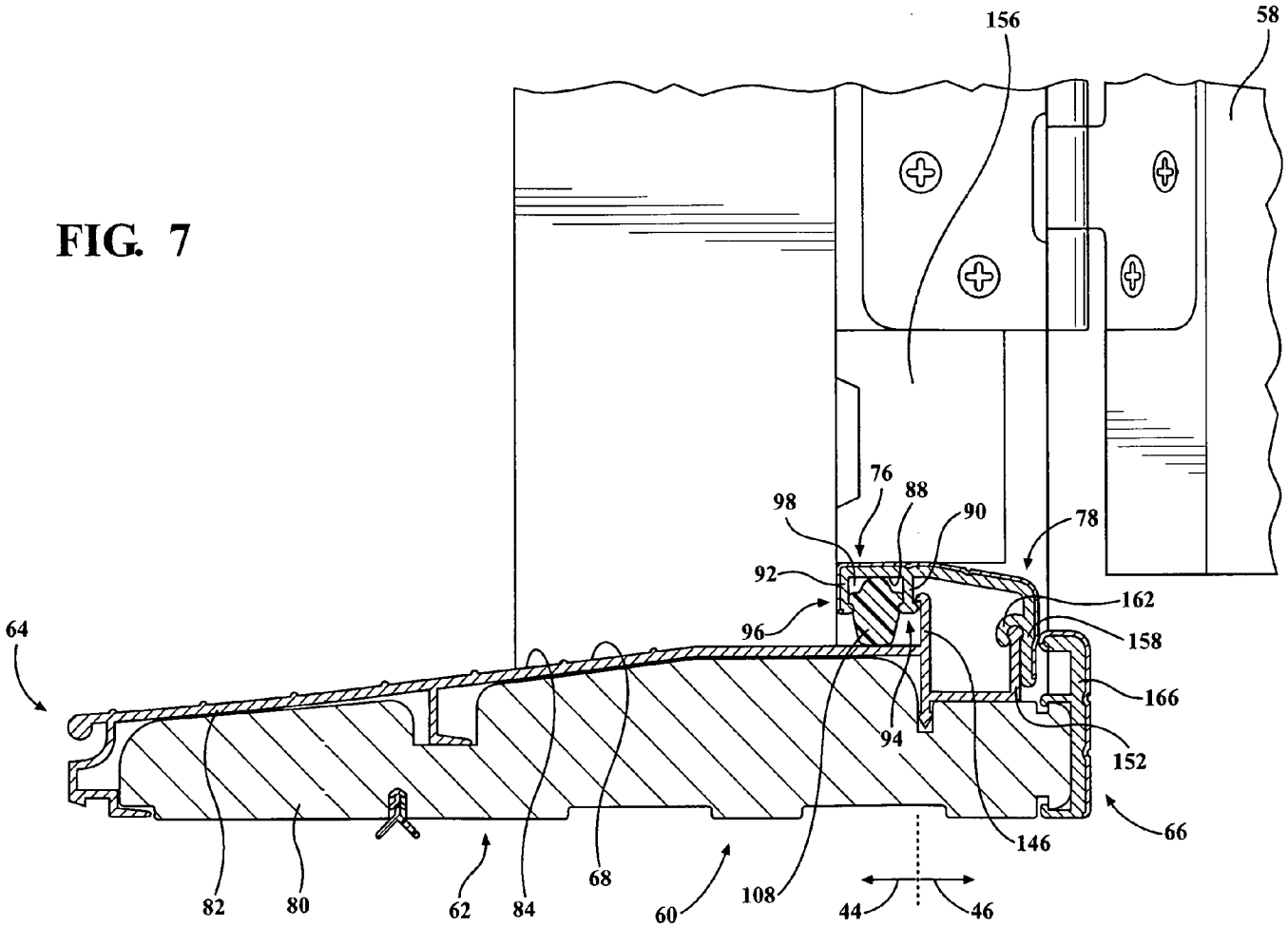
FIG. 7 is a side cross-sectional view of the threshold assembly, with the door panel in the open position and the rail in the initial position, and with the sill comprising the sill base and the sill deck.
Figure 8:
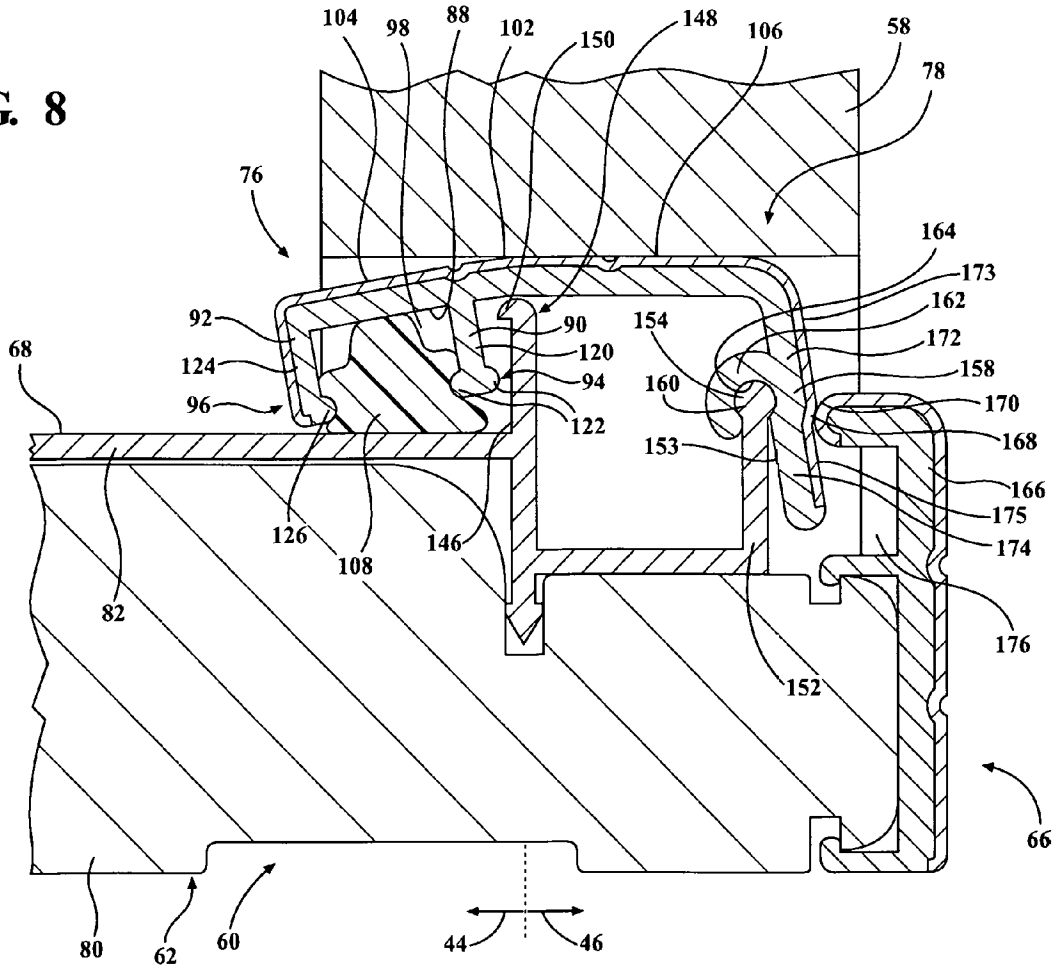
FIG. 8 is an enlarged side cross-sectional view of the threshold assembly, with the door panel in the closed position and the rail in the second position.

Typically, the nosing 166 is a separate component from the sill 62, as shown in FIG. 7; however, it is to be appreciated that the nosing 166 may also be a component of the sill 62. As discussed above, the sill 62 may comprise the sill base 80 and the sill deck 82, which produces a two-piece sill 62. When the nosing 166 is a component of the sill 62, the sill 62 is a three-piece sill 62. When the sill 62 is a three-piece sill 62, the nosing 166 is typically comprised of a rigid plastic. However, it is to be appreciated that the nosing 166 may comprise any material having the desired rigidity. The nosing 166 is typically produced using an extrusion process; however, it is to be appreciated that the process for producing the nosing 166 may be any suitable manufacturing process. It is to be appreciated that the nosing 166 may be integrally formed with the sill 62, or the sill base 80 and the sill deck 82, to form a one-piece sill 62, as shown in FIG. 3.

The rail 74, including first retaining arm 90, the second retaining arm 92, and the rear extension 158, is typically comprised of a rigid plastic; however, it is to be appreciated that the rail 74 may comprise any material having the desired rigidity. Typically, the rail 74 is produced using an extrusion process. However, it is to be appreciated that the process for producing the rail 74 may be any suitable manufacturing process.

The nosing 166 and the protrusion 152 may define a void 176 therebetween. Typically, the rear extension 158 is pivotable or rotatable within the void 176 to accommodate movement of the rail 74 between the initial position and the second position. The nosing 166 typically extends upwardly into the opening 54 in an "L-shaped" configuration. Said differently, the nosing 166 extends from the sill 62 toward the door head 56.

Typically, when the sill 62 has the projection 146 and the protrusion 152, the first retaining arm 90 of the rail is engageable with the projection 146, and the rear extension 158 is engageable with the protrusion 152 such that the engagement between the rear extension 158 and the protrusion 152 prevents the biasing member 108 from biasing the leading edge 76 beyond the initial position. In certain embodiments, the rear extension 158 extends past the bulb tip 160 of the protrusion 152 to define an engagement surface 153 facing the protrusion 152 and opposite the nosing 166. In these embodiments, the engagement surface 153 engages the protrusion 152 when the rail 74 is in the initial position and the engagement surface 153 is spaced from the protrusion 152 when the rail 74 is in the second position.

In certain embodiments, (1) the engagement between the rear extension 158 and the protrusion 152 and (2) the engagement between the first retaining arm 90 and the projection 146, collectively prevents the biasing member 108 from biasing the leading edge 76 to pivot beyond the initial position. Specifically, engagement between the first retaining arm 90 and the projection 146 and engagement between the rear extension 158 and the protrusion 152 prevents further pivoting of the leading edge 76 beyond the initial position, which keeps tension within the biasing member 108 such that the second portion 112 of the biasing member 108 remains engaged with the upper sill surface 68 to continuously bias the rail 74 toward the initial position. Also, the tension within the biasing member 108 allows the second portion 112 of the biasing member 108 to remain engaged with the upper sill surface 68 for sealing the interior 46 of the structure 42. Additionally, the engagement of the rear extension 158 with the protrusion 152 and the engagement of the first retaining arm 90 with the projection 146 prevents further pivoting of the leading edge 76 of the rail 74 about the protrusion 152 beyond the initial position such that the biasing member 108 is slightly compressed in the initial position.

Figure 9:
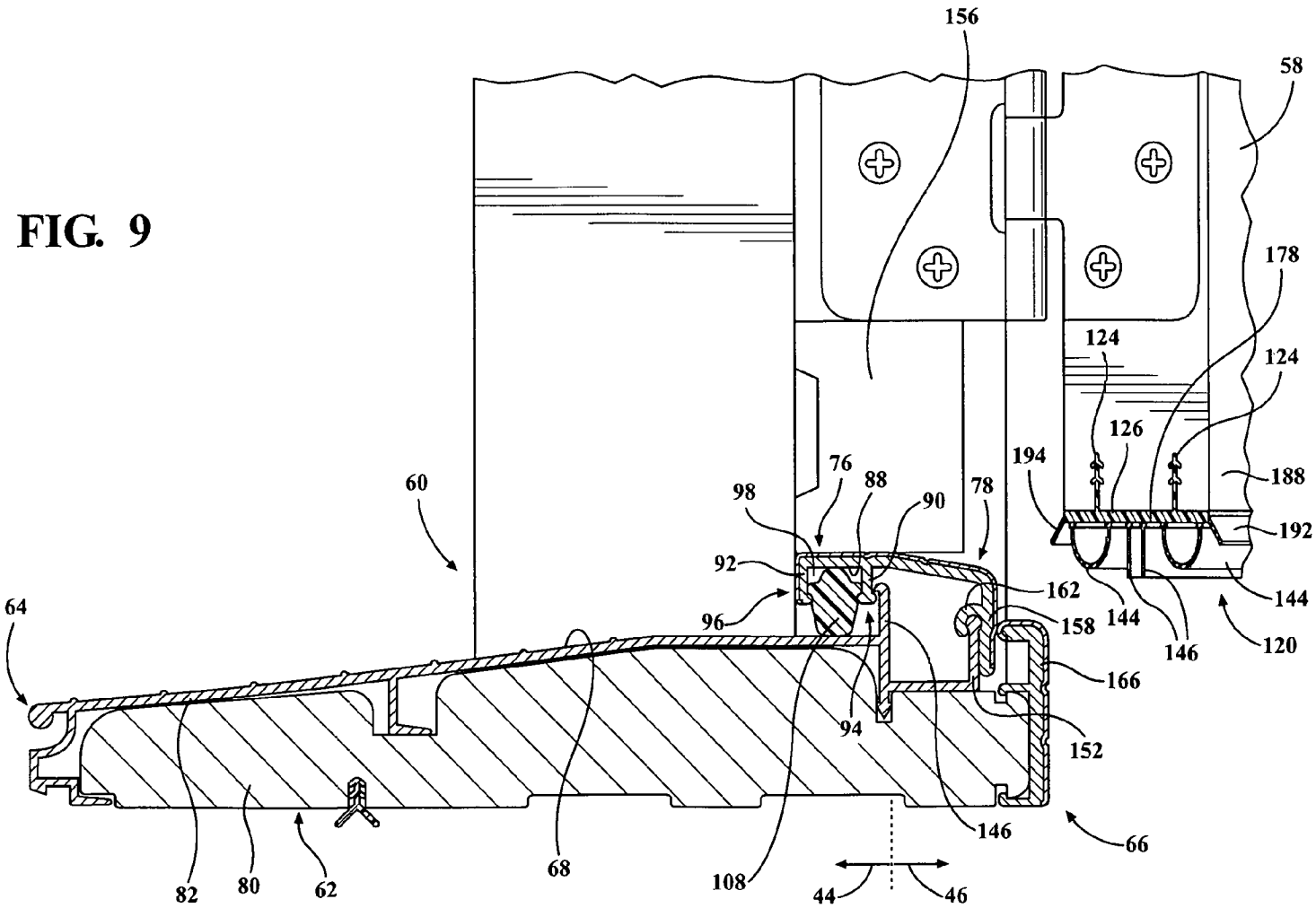
FIG. 9 is a side cross-sectional view of the threshold assembly, the first door jamb of the door frame, the door panel, and a door sweep, with the door panel in the open position and the rail in the initial position.
Figure 10:
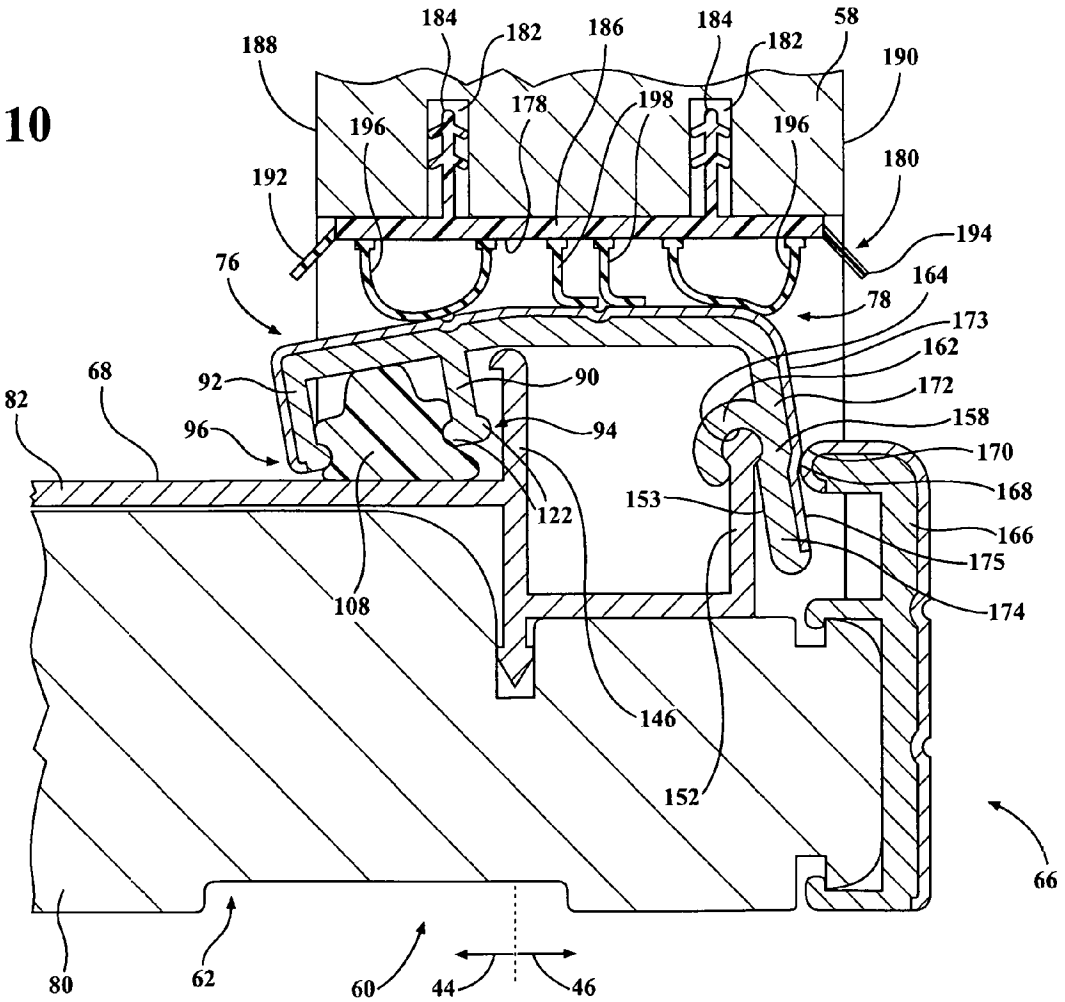
FIG. 10 is an enlarged side cross-sectional view of the threshold assembly, the first door jamb of the door frame, the door panel, and the door sweep, with the door panel in the closed position and the rail in the second position.
Figure 11:
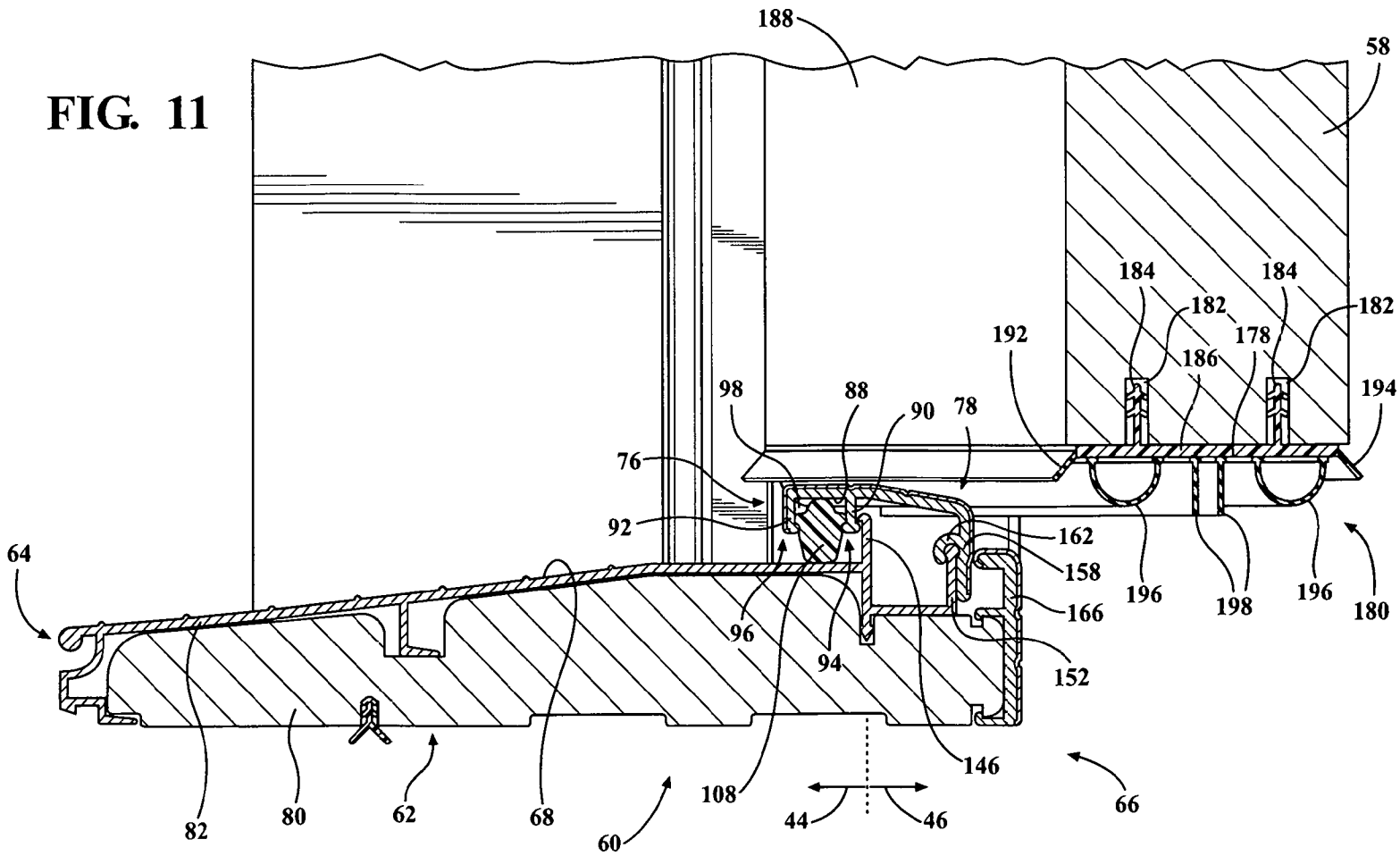
FIG. 11 is a side cross-sectional view of the threshold assembly, the first door jamb of the door frame, the door panel, and the door sweep, with the door panel in the open position and the rail in the initial position.
Figure 12:
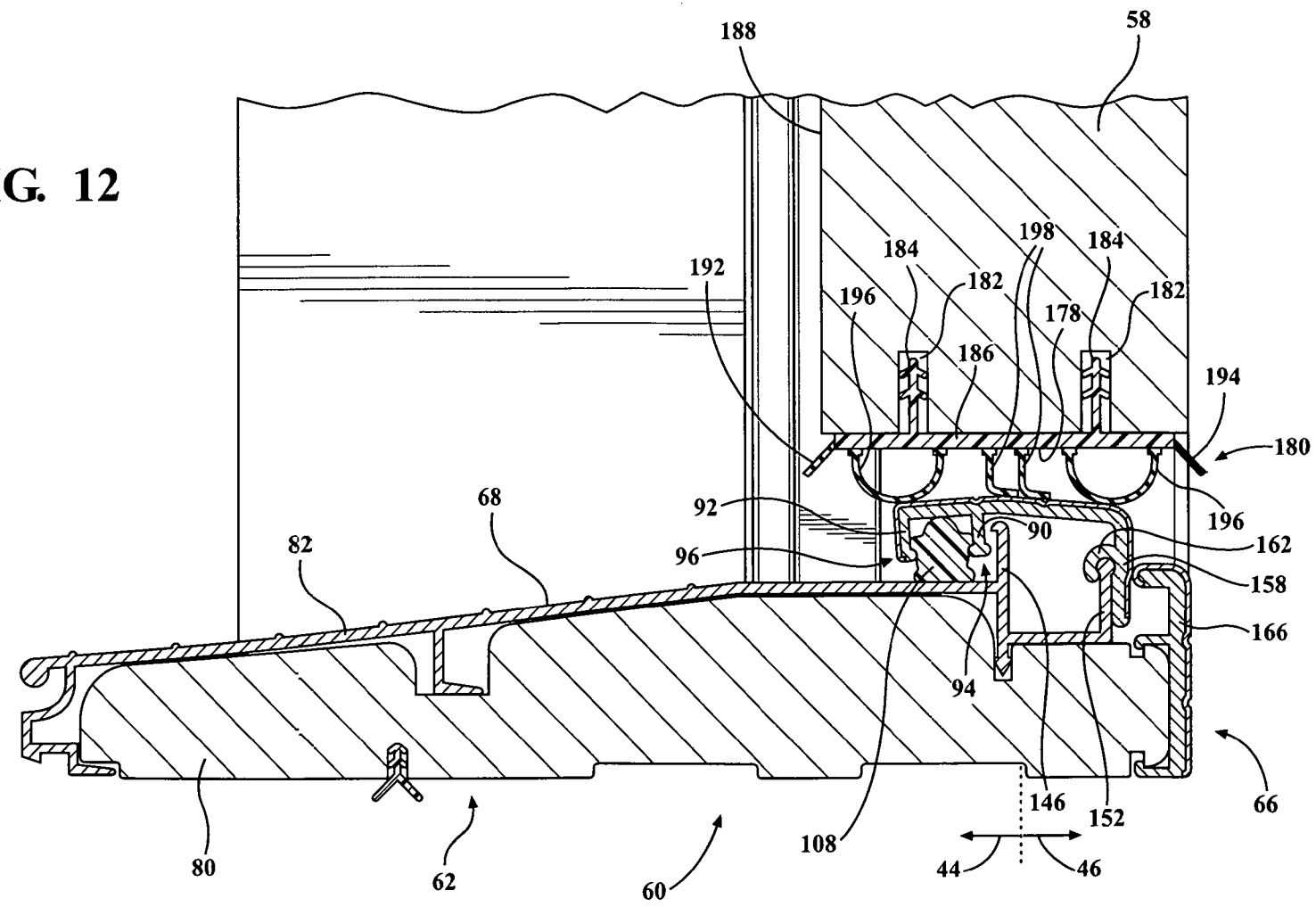
FIG. 12 is a side cross-sectional view of the threshold assembly, the first door jamb of the door frame, the door panel, and the door sweep, with the door panel in the closed position and the rail in the second position.
Figure 13:
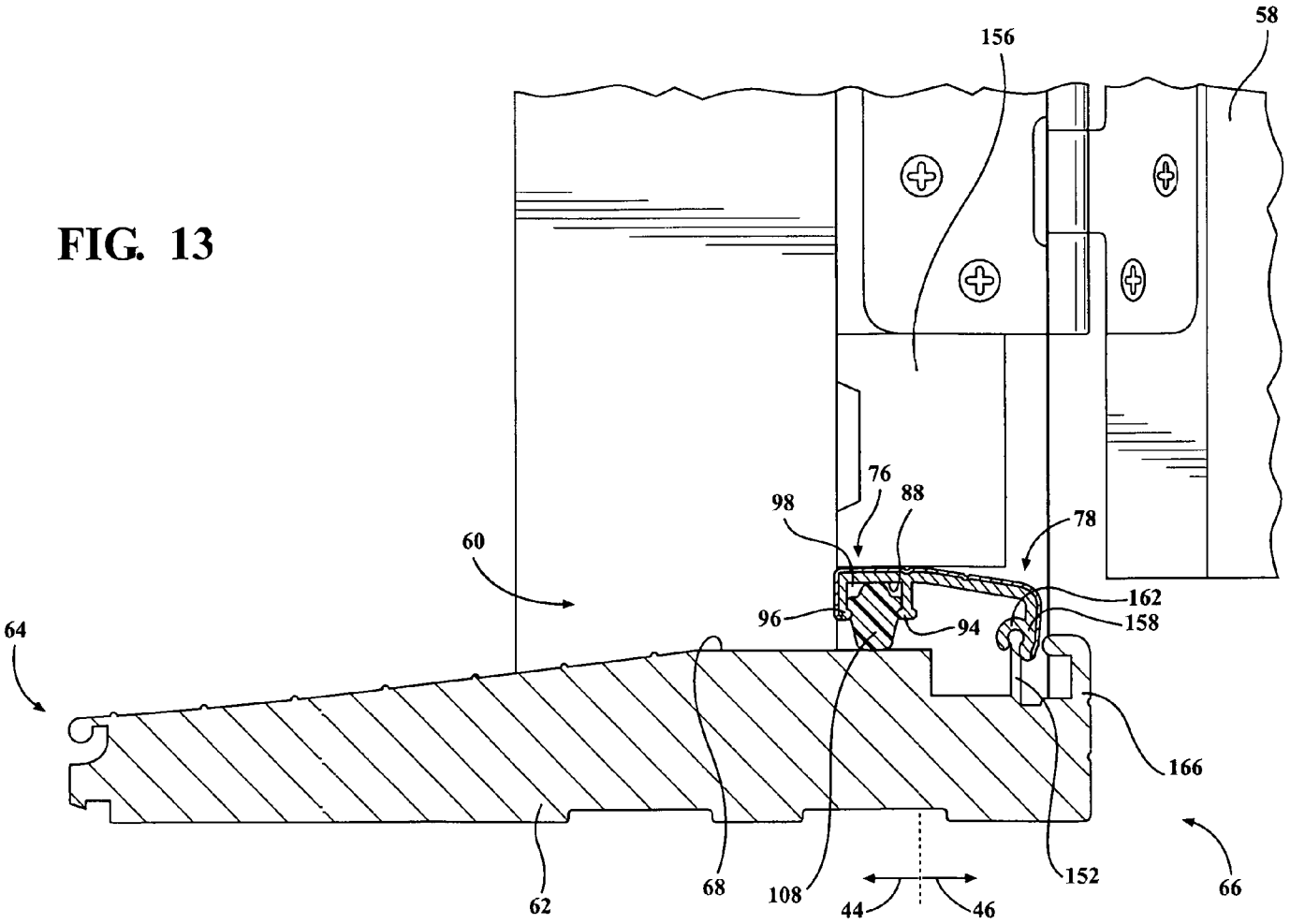
FIG. 13 is a side cross-sectional view of the threshold assembly, the first door jamb of the door frame, the door panel showing, and another embodiment of the rail, with the door panel in the open position and the rail in the initial position.
Figure 14:
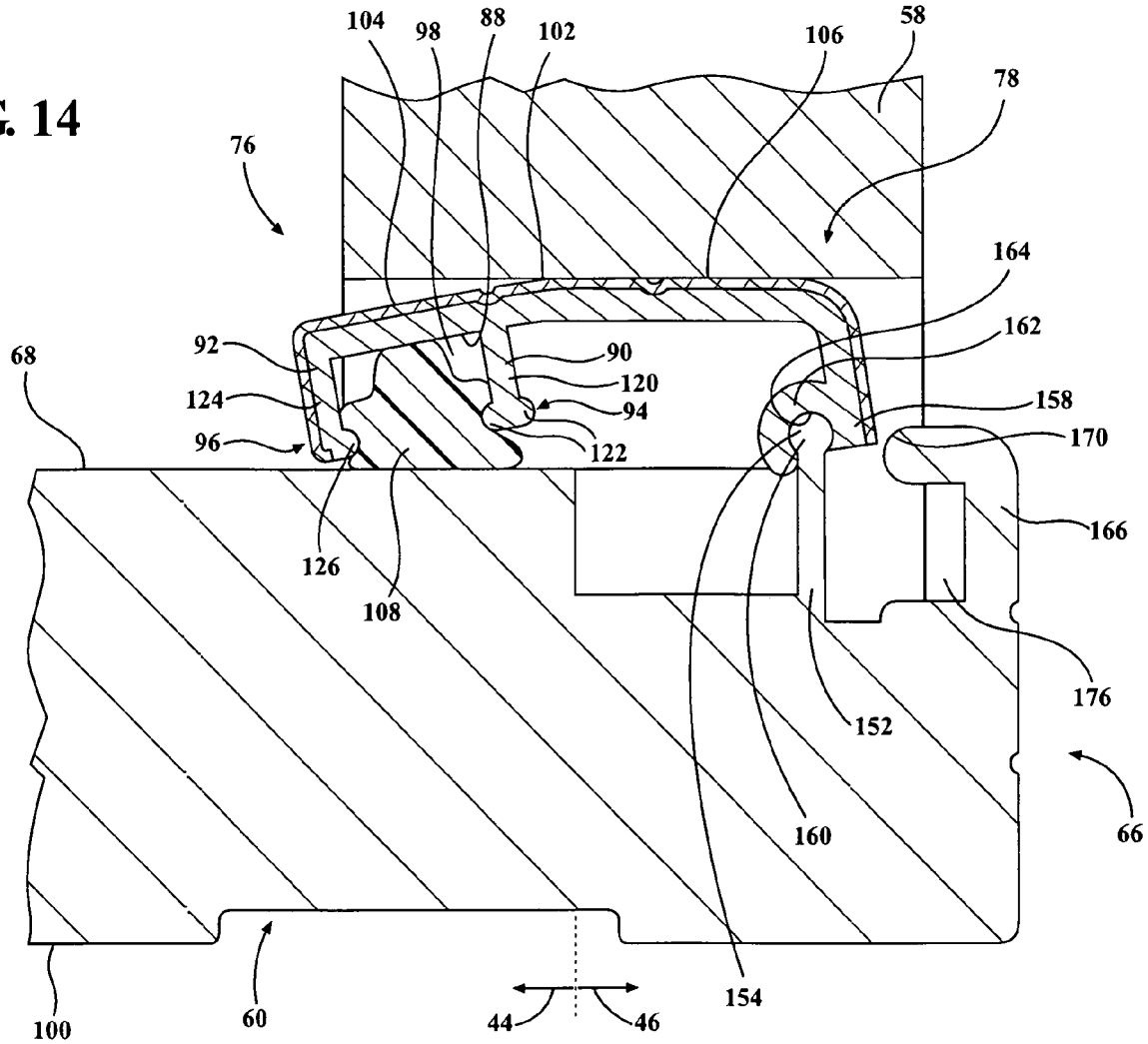
FIG. 14 is an enlarged side cross-sectional view of a portion of the threshold assembly and the rail of FIG. 13, with the door panel in the closed position and the rail in the second position.
Figure 15:
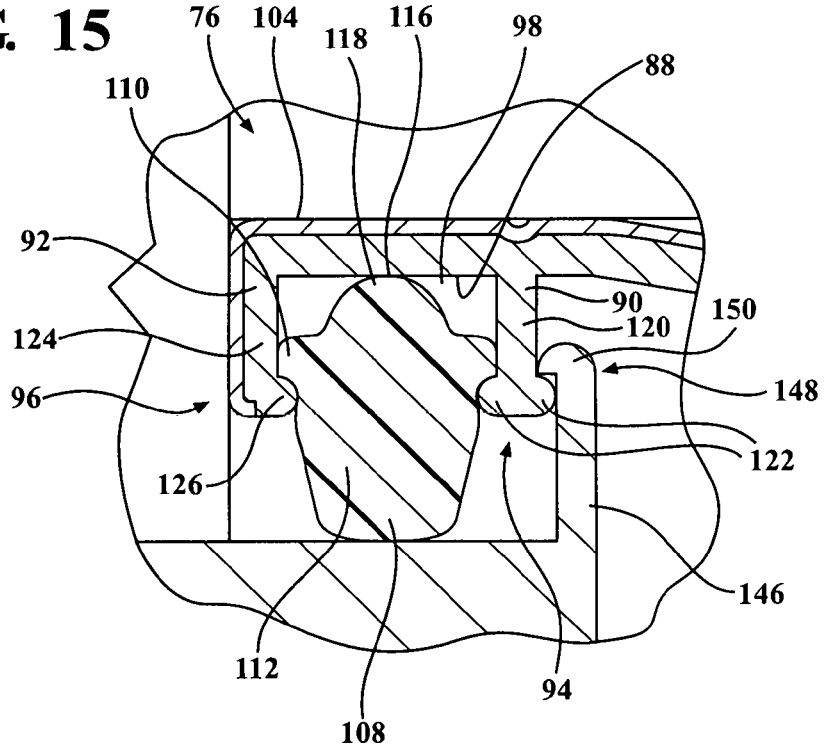
FIG. 15 is an enlarged side cross-sectional view of the rail in the initial position.

As described above and shown in FIGS. 3 and 4, as the door panel 58 moves from the open position to the closed position, the door panel 58 may engage and move the rail 74 from the initial position to the second position. More specifically, the door panel 58 has a lower door surface 178 facing the threshold assembly 60 with the lower door surface 178 engaging the rail 74. Alternatively, the door panel 58 may include a door sweep 180 configured to engage the rail 74 with the door sweep 180 moving the rail 74 from the initial position, as shown in FIG. 9, toward the second position, as shown in FIGS. 10 and 12, as the door panel 58 moves into the closed position against the biasing of the biasing member 108. FIG. 11 shows the door panel 58 between the open position and the closed position. When present, the door sweep 180 engages the rail 74 for sealing against the rail 74. It is to be appreciated that movement of the rail 74 between the initial position to the second position can be accomplished with or without the door sweep 180 present.

The door sweep 180 is typically disposed longitudinally along, and coupled to, the lower door surface 178 of the door panel 58. As best shown in FIG. 10, the lower door surface 178 of the door panel 58 may define at least one kerf 182. Typically, the at least one kerf 182 extends inwardly from the lower door surface 178. Further, typically the at least one kerf 182 is defined longitudinally along the door panel 58. It is to be appreciated that the at least one kerf 182 defined by the door panel 58 may comprise a plurality of kerfs 182. Additionally, the door sweep 180 may include at least one sweep leg 184 coupled to and extending from the door sweep 180 toward the door panel 58 for engaging the door panel 58 within the kerf 182 or kerfs 182. The at least one sweep leg 184 extends longitudinally along the lower door surface 178 of the door panel 58. Generally, engagement of the sweep leg 184 with the door panel 58 within the at least one kerf 182 couples the door sweep 180 to the door panel 58. However, it is to be appreciated that the door sweep 180 may be coupled to the door panel 58 by any suitable method.

The door sweep 180 may have a frame 186. When present, the frame 186 extends longitudinally along the lower door surface 178 of the door panel 58. Typically, the frame 186 extends longitudinally along the entirety of the lower door surface 178; however, it is to be appreciated that the frame 186 may extend longitudinally along a portion of the lower door surface 178. Generally, the frame 186 extends to an outside surface 188 of the door panel 58 facing the exterior 44 of the structure 42 when the door panel 58 is in the closed position and to an inside surface 190 of the door panel 58 facing the interior 46 of the structure 42 when the door panel 58 is in the closed position, as shown in FIGS. 10 and 12.

The door sweep 180 may include an outside seal 192. When present, the outside seal 192 extends longitudinally along the frame 186. Typically, the outside seal 192 extends longitudinally along the entirety of the frame 186; however, it is to be appreciated that the outside seal 192 may extend longitudinally along a portion of the frame 186. The outside seal 192 may extend angularly from the frame 186 adjacent to the outside surface 188 away from the door panel 58 and toward the exterior side 64 of the sill 62 when the door panel 58 is in the closed position. The outside seal 192 positively drains the fluid off of the outside surface 188 of the door panel 58 to prevent the infiltration of the fluid between the door panel 58 and the door sweep 180 and between the door panel 58 and the sill 62.

The door sweep 180 may include an inside seal 194. When present, the inside seal 194 extends longitudinally along the frame 186. Typically, the inside seal 194 extends longitudinally along the entirety of the frame 186; however, it is to be appreciated that the inside seal 194 may extend longitudinally along a portion of the frame 186. The inside seal 194 may extend angularly from the frame 186 adjacent to the inside surface 190 away from the door panel 58 and toward the interior side 66 of the sill 62 when the door panel 58 is in the closed position. The inside seal 194 positively drains the fluid off of the inside surface 190 of the door panel 58 to prevent the infiltration of the fluid between the door panel 58 and the door sweep 180.

The door sweep 180 may include at least one bulb seal 196. When present, the at least one bulb seal 196 extends longitudinally along the lower door surface 178 of the door panel 58. Typically, the at least one bulb seal 196 extends longitudinally along the entirety of the lower door surface 178; however, it is to be appreciated that the at least one bulb seal 196 may extend longitudinally along a portion of the lower door surface 178. The at least one bulb seal 196 typically has an arcuate configuration as shown in FIG. 10. It is to be appreciated that the at least one bulb seal 196 may have a linear configuration, or any other suitable configuration. Typically, the at least bulb seal 196 is further defined as a pair of bulb seals 196. It is to be appreciated that the at least one bulb seal 196 may be a single bulb seal or any number of bulb seals 196.

When the pair of bulb seals 196 is present, the bulb seals 196 are typically spaced from one another. It is to be appreciated that the pair of bulb seals 196 may be adjacent to one another. The pair of bulb seals 196 are typically positioned such that one of the pair of bulb seals 196 is adjacent to the outside surface 188 of the door panel 58 and another one of the pair of bulb seals 196 is adjacent to the inside surface 190 of the door panel 58. It is to be appreciated that the pair of bulb seals 196 may be positioned anywhere between the outside and inside surfaces 188, 190.

As shown in FIG. 10, the at least one bulb seal 196 engages the rail 74 when the door panel 58 is in the closed position. More specifically, the pair of bulb seals 196 engages the rail 74 and moves the rail 74 into the second position. Engagement of the pair of bulb seals 196 with the rail 74 may cause the pair of bulb seals 196 to deflect. The bias exerted by the biasing member 108 simultaneously biases the rail 74 toward the pair of bulb seals 196. As such, the engagement of the pair of bulb seals 196 with the rail 74 causes both the movement of the rail 74 into the second position and the deflection of the pair of bulb seals 196, with the rail 74 and the pair of bulb seals 196 abutting and sealing against one another over a greater surface area to prevent negative drainage of the fluid toward the interior 46 of the structure 42. It is to be appreciated that the pair of bulb seals 196 may be rigid such that pair of bulb seals 196 does not flex or minimally flexes when the pair of bulb seals 196 engages the rail 74. Furthermore, it is to be appreciated that the pair of bulb seals 196 may have any suitable rigidity.

The door sweep 180 may include at least one fin 198 extending downwardly from the frame 186 toward the sill 62. When present, the at least one fin 198 extends longitudinally along the lower door surface 178 of the door panel 58. Typically, the at least one fin 198 extends longitudinally along the entirety of the lower door surface 178; however, it is to be appreciated that the at least one fin 198 may extend longitudinally along a portion of the lower door surface 178. With the door panel 58 in the open position, the at least one fin 198 has a substantially linear configuration. With the door panel 58 in the closed position, the at least one fin 198 may abut and seal against the rail 74 to prevent backflow of the fluid over the rail 74 resulting in negative drainage off of the rail 74 toward the interior side 66 of the sill 62. The abutment of the at least one fin 198 with the rail 74 may cause the at least one fin 198 to flex such that a portion of the at least one fin 198 lies along and seals against the rail 74. It is also to be appreciated that the at least one fin 198 may be spaced from the rail 74 with the at least one fin 198 blocking a majority of the fluid from passing between the door panel 58 and the sill 62 toward the interior side 66 of the sill 62, and facilitating drainage of the fluid off of the outside surface 188 of the door panel 58 toward the rail 74 for positive drainage off of the sill 62. Typically, the at least one fin 198 is further defined as a pair of fins 198. It is to be appreciated that the at least one fin 198 may be a single fin or any number of fins.

When the pair of fins 198 is present, the fins 198 are typically spaced from one another. It is to be appreciated that the pair of fins 198 may be adjacent to one another. The pair of fins 198 are typically positioned between the outside surface 188 of the door panel 58 and the inside surface 190 of the door panel 58. More specifically, the pair of fins 198 is typically positioned between the pair of bulb seals 196. It is to be appreciated that one of the pair of fins 198 may be spaced from the rail 74 while another one of the pair of fins 198 may abut the rail 74. Furthermore, it is to be appreciated that both of the pair of fins 198 may abut the rail 74 or may be spaced from the rail 74.

Typically, the outside and inside seals 192, 194, the at least one bulb seal 196, and the at least one fin 198 are comprised of flexible polyvinyl chloride (PVC); however, it is to be appreciated that the outside and inside seals 192, 194, the at least one bulb seal 196, and the at least one fin 198 may be comprised of flexible sponge silicone or any other material of suitable flexibility.

The extent of the pivoting of the leading edge 76 toward the sill 62 in the second position is dependent upon the proximity of the door panel 58 to the threshold assembly 60. The proximity of the door panel 58 to the threshold assembly 60 may vary longitudinally along the threshold assembly 60. Such variations in the proximity of the door panel 58 to the threshold assembly 60 may be a result of the alignment of the door panel 58 or the threshold assembly 60 within the entryway system 40. The variations in the proximity of the door panel 58 to the threshold assembly 60 may further be a result of non-planar configuration of the lower door surface 178 or the door sweep 180.

As the lower door surface 178 of the door panel 58, and the door sweep 180 (if present), extends further toward the threshold assembly 60, the rail 74 moves further toward the upper sill surface 68. The second distance D2 of the rail 72 in the second position shown in FIG. 4 may be any one of a plurality of distances.

The second distance D2 of the rail 74 may vary longitudinally along the rail 74. Specifically, changes in the proximity of the lower door surface 178 of the door panel 58, and the door sweep 180 (if present) coupled to the lower door surface 178, toward the threshold assembly 60 longitudinally along the rail 74 facilitate varying movement of the rail 74 along the sill 62 and varying second distances D2 along the sill 62. The varying of the second distance D2 of the rail 74 along the lower door surface 178, and the door sweep 180 coupled to the lower door surface 178, ensures engagement of the rail 74 with the door panel 58 longitudinally along the threshold assembly 60.

The operation of moving of the door panel 58 from the open position to the closed position and the corresponding concurrent movement of the rail 74 from the initial position to the second position, and the operation of moving the door panel 58 from the closed position to the open position and the corresponding concurrent movement of the rail 74 from the second position to the initial position, are described immediately below.

Beginning with the door panel 58 in the open position and the rail 74 in the initial position, as shown in FIG. 3, the door panel 58 is pivoted relative to the first door jamb 50 toward the closed position. The door panel 58 or, if present, the door sweep 180, engages the secondary and primary rail surfaces 106, 104 of the rail 74 adjacent the first door jamb 50, which facilitates movement of the rail 74 relative to the upper sill surface 68. The engagement of the door panel 58 or, if present, the door sweep 180, with the secondary and primary surfaces 106, 104 of the rail 74 adjacent the first door jamb 50 is within the range of closed positions as described above. The door panel 58 or, if present, the door sweep 180, progressively engages the secondary and primary surfaces 106, 104 along the rail 74 moving away from the first door jamb 50 toward the second door jamb 52 as the door panel 58 continues to pivot toward the completely closed position, as shown in FIG. 11. As the rail 74 moves from the initial position to the second position, the biasing member 108 compresses between the lower rail surface 88 and the upper sill surface 68 due to the force of the door panel 58 acting on the rail 74. As the biasing member 108 compresses and biases against movement of the rail 74 from the initial position toward the second position caused by the door panel 58 moving from the open position to the closed position, the rail 74 is continually biased against the lower door surface 178 or the door sweep 180 (if present), as shown in FIG. 10.

The rail 74 is further moved into the second position. With the door panel 58 in the completely closed position, the rail 74 is disposed in the second position with the second distance D2 of the rail 74 varying longitudinally along the rail 74 to accommodate engagement of the rail 74 with the lower door surface 178 or the door sweep 180 (if present). Engagement of the rail 74 with the lower door surface 178 or the door sweep 180 (if present) seals the opening 54 between the threshold assembly 60 and the door panel 58.

Beginning with the door panel 58 in the closed position and the rail 74 therefore in the second position, as shown in FIG. 4, the door panel 58 is pivoted relative to the first door jamb 50 toward the open position. The door panel 58 or, if present, the door sweep 180, disengages the primary and secondary rail surfaces 104, 106 of the rail 74 adjacent the first door jamb 50, which facilitates movement of the rail 74 relative to the upper sill surface 68 due to the bias of the biasing member 108. The door panel 58 or, if present, the door sweep 180, progressively disengages the primary and secondary surfaces 104, 106 along the rail 74 moving toward the first door jamb 50 and away from the second door jamb 52 as the door panel 58 continues to pivot toward the open position, as shown in FIG. 11.

The rail 74 is further moved into the initial position. With the door panel 58 in the open position, the rail 74 is disposed in the initial position. When the sill 62 has the projection 146, the first retaining arm 90 typically engages the projection 146 to stop further pivoting of the leading edge 76 of the rail 74 beyond the initial position caused by the bias of the biasing member 108 such that the biasing member 108 is slightly compressed in the initial position. When the rail 74 has the rear extension 158 and when the sill 62 has the protrusion 152, the rear extension 158 engages the protrusion 152 to prevent pivoting of the leading edge 76 of the rail 74 about the protrusion 152 beyond the initial position caused by the bias of the biasing member 108 such that the biasing member 108 is slightly compressed in the initial position. The slight compression of the biasing member 108 when the rail 74 is in the initial position and the further compression of the biasing member 108 when the rail 74 is in the second position seals the interior 46 from the exterior 44 between the lower rail surface 88 and the upper sill surface 68. Also, the slight compression of the biasing member 108 when the rail 74 is in the initial position and the further compression of the biasing member 108 when the rail 74 is in the second position seals the interior 46 from the exterior 44 between the lower door surface 178 and the upper rail surface 103. The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A threshold assembly for use with an entryway disposed within an aperture of a structure, which has an exterior and an interior and includes a door panel moveable between open and closed positions, said threshold assembly comprising:

a sill extending between an exterior side for facing the exterior of the structure and an interior side for facing the interior of the structure with said sill presenting an upper sill surface extending from said exterior side to said interior side and configured to face the door panel in the closed position;

a rail rotatably supported above said upper sill surface of said sill between an initial position when the door panel is in the open position, and a second position different from said initial position when the door panel is in the closed position;

a biasing member disposed between said upper sill surface of said sill and said rail, such that said biasing member is engaged with said rail and supported by said upper sill surface to bias said rail from said second position toward said initial position; and a protrusion extending from said sill towards said rail;

wherein said protrusion is configured to rotatably support said rail and configured to prevent said biasing member from rotating said rail beyond said initial position;

wherein said rail has a rear extension extending toward said upper sill surface, with said rear extension engageable with said protrusion of said sill;

wherein said protrusion defines a bulb tip at a terminal end with said bulb tip having a rounded configuration; and wherein and said rear extension has a protuberance extending from said rear extension toward said biasing member, with said protuberance defining a channel, with said protuberance partially surrounding and configured to receive said bulb tip within said channel such that said protuberance rotates about said bulb tip as said rail rotates between said initial and second positions.

2. The threshold assembly as set forth in claim 1 wherein said protrusion is disposed adjacent said interior side of said sill.

3. The threshold assembly as set forth in claim 1 wherein said rail has a leading edge facing said exterior side and a rear edge facing said interior side, and said rail has a lower rail surface facing said upper sill surface and an arm extending from said lower rail surface toward said upper sill surface.

4. The threshold assembly as set forth in claim 1 wherein said rear extension prevents said biasing member from rotating said rail beyond said initial position.

5. The threshold assembly as set forth in claim 4 further comprising a nosing disposed adjacent said interior side of said sill, with said nosing defining a rounded corner engaging said rear extension.

6. The threshold assembly as set forth in claim 5 wherein said nosing and said protrusion define a void therebetween, with said rear extension movable within said void to accommodate rotation of said rail between said initial position and said second position.

7. The threshold assembly as set forth in claim 5 wherein said rear extension defines a transition surface opposite said protrusion and facing said nosing, with said transition surface configured to rotate about said rounded corner of said nosing.

8. The threshold assembly as set forth in claim 7 wherein said rear extension defines a first surface and a second surface with said transition surface connecting said first and second surfaces, and wherein said transition surface is transverse to said first and second surfaces.

9. The threshold assembly of claim 4 wherein said rear extension extends past said bulb tip of said protrusion to define an engagement surface facing said protrusion.

10. The threshold assembly as set forth in claim 9, wherein said engagement surface engages said protrusion when said rail is in said initial position and said engagement surface is spaced from said protrusion when said rail is in said second position.

11. The threshold assembly as set forth in claim 1 wherein said biasing member is continuously engaged with said upper sill surface and is resiliently deformed when said rail is in said second position.

12. The threshold assembly as set forth in claim 1 wherein said biasing member comprises an elastomer.

13. The threshold assembly as set forth in claim 1 wherein said rail is rigid.

14. The threshold assembly as set forth in claim 1 wherein said sill has a projection extending from said upper sill surface toward said rail, with said projection disposed between said biasing member and said protrusion.

15. A threshold assembly for use with an entryway disposed within an aperture of a structure, which has an exterior and an interior and includes a door panel moveable between open and closed positions, said threshold assembly comprising:

a sill extending between an exterior side for facing the exterior of the structure and an interior side for facing the interior of the structure with said sill presenting an upper sill surface extending from said exterior side to said interior side and configured to face the door panel in the closed position;

a rail rotatably supported above said upper sill surface of said sill between an initial position when the door panel is in the open position, and a second position different from said initial position when the door panel is in the closed position;

a biasing member comprising an elastomeric material and disposed between said upper sill surface of said sill and said rail, such that said biasing member is engaged with said rail and supported by said upper sill surface to bias said rail from said second position toward said initial position; and a protrusion extending toward said rail to a terminal end defining a bulb tip with a rounded configuration;

wherein said rail has a rear extension extending toward said upper sill surface with said rear extension having a protuberance extending therefrom towards said biasing member, with said protuberance defining a channel and said protuberance partially surrounding and configured to receive said bulb tip within said channel such that said protuberance rotates about said bulb tip as said rail rotates between said initial and second positions;

wherein said rear extension extends past said bulb tip of said protrusion to define an engagement surface facing said protrusion with said engagement surface engaging said protrusion when said rail is in said initial position and said engagement surface spaced from said protrusion when said rail is in said second position; and wherein said rail is rigid.

16. The threshold assembly as set forth in claim 15 further comprising a nosing disposed adjacent said interior side of said sill, with said nosing defining a rounded corner engaging said rear extension;

wherein said rear extension defines a transition surface opposite said protrusion and facing said nosing, said rear extension defining a first surface and a second surface with said transition surface connecting said first and second surfaces, and wherein said transition surface is transverse to said first and second surfaces; and wherein said rear extension is configured to rotate about said rounded corner of said nosing while said protuberance rotates about said bulb tip.

17. The threshold assembly as set forth in claim 15 wherein said biasing member is continuously engaged with said upper sill surface to accommodate movement of said rail between said initial position and said second position.

18. A threshold assembly for use with an entryway disposed within an aperture of a structure, which has an exterior and an interior and includes a door panel moveable between open and closed positions, said threshold assembly comprising:

a sill extending between an exterior side for facing the exterior of the structure and an interior side for facing the interior of the structure with said sill presenting an upper sill surface extending from said exterior side to said interior side and configured to face the door panel in the closed position;

a rail supported above said upper sill surface of said sill between an initial position when the door panel is in the open position, and a second position different from said initial position when the door panel is in the closed position; and a protrusion extending from said sill toward said rail to a terminal end;

wherein said rail has a rear extension extending toward said upper sill surface past said terminal end of said protrusion to define an engagement surface facing said protrusion with said engagement surface abutting said protrusion; and wherein at least a portion of said rail rotates between said initial position and said second position; and wherein said rail defines a channel at least partially surrounding and configured to receive said terminal end of said protrusion such that said rail rotates about said terminal end as said rail rotates between said initial and second positions.

19. A threshold assembly for use with an entryway disposed within an aperture of a structure, which has an exterior and an interior and includes a door panel moveable between open and closed positions, said threshold assembly comprising:

a sill extending between an exterior side for facing the exterior of the structure and an interior side for facing the interior of the structure with said sill presenting an upper sill surface extending from said exterior side to said interior side and configured to face the door panel in the closed position;

a rail supported above said upper sill surface of said sill between an initial position when the door panel is in the open position, and a second position different from said initial position when the door panel is in the closed position;

a protrusion extending from said sill toward said rail to a terminal end; and a biasing member integral with said rail and disposed between said upper sill surface of said sill and said rail, such that said biasing member is engaged with said rail and supported by said upper sill surface to bias said rail from said second position toward said initial position;

wherein said rail has a rear extension extending toward said upper sill surface past said terminal end of said protrusion to define an engagement surface facing said protrusion with said engagement surface abutting said protrusion; and wherein at least a portion of said rail rotates between said initial position and said second position.

* * * * *